US008014704B2

(12) United States Patent
Matsumoto et al.

(10) Patent No.: US 8,014,704 B2
(45) Date of Patent: Sep. 6, 2011

(54) DEVELOPING AGENT STORAGE DEVICE AND IMAGE FORMING APPARATUS HAVING SAME IN WHICH THE CHARGEABILITY LEVEL OF THE TONER, STORAGE DEVICE, AND CARRIER HAVE A SPECIFIC RELATIONSHIP

(75) Inventors: Keiko Matsumoto, Yokohama (JP); Emi Kita, Tokyo (JP); Mugijirou Uno, Isehara (JP); Satoru Miyamoto, Ebina (JP); Junichi Terai, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 373 days.

(21) Appl. No.: 12/114,164

(22) Filed: May 2, 2008

(65) Prior Publication Data

US 2008/0279592 A1 Nov. 13, 2008

(30) Foreign Application Priority Data

May 8, 2007 (JP) ..... 2007-123286
Dec. 6, 2007 (JP) ..... 2007-316233
Feb. 15, 2008 (JP) ..... 2008-034852

(51) Int. Cl.
*G03G 15/08* (2006.01)

(52) U.S. Cl. ..... 399/258; 399/259

(58) Field of Classification Search ..... 399/119, 399/120, 258, 259, 262
See application file for complete search history.

(56) References Cited

U.S. PATENT DOCUMENTS 4,873,551 A 10/1989 Tajima et al.
6,275,675 B1 * 8/2001 Cornelius ..... 399/262
6,819,897 B2 11/2004 Kita
6,882,817 B2 4/2005 Kita
7,123,865 B2 10/2006 Kita
7,133,629 B2 11/2006 Kita
7,184,691 B2 2/2007 Kita et al.
2003/0118375 A1 * 6/2003 Litwiller ..... 399/262
2006/0002743 A1 1/2006 Katsuyama et al.
2006/0093946 A1 5/2006 Miyamoto et al.
2007/0077098 A1 4/2007 Katsuyama et al.
2007/0116494 A1 5/2007 Uno et al.
2007/0122204 A1 5/2007 Kita
2007/0140747 A1 6/2007 Kita et al.

(Continued)

FOREIGN PATENT DOCUMENTS

EP 1 361 481 A1 11/2003

(Continued)

OTHER PUBLICATIONS

Machine English translation of JP08-110691.*

*Primary Examiner* — David M Gray
*Assistant Examiner* — Billy J Lactaoen
(74) *Attorney, Agent, or Firm* — Oblon, Spivak, McClelland, Maier & Neustadt, L.L.P.

(57) ABSTRACT

A developing agent storage device for storing a refill developing agent includes toner particles, carrier particles, an inner layer of the developing agent storage device. The toner particles and carrier particles compose the refill developing agent. The inner layer is provided as a wall contacting the refill developing agent. An electrostatic chargeability level of the toner particles, the carrier particles, and the inner layer is set in an order of toner, inner layer, and carrier from any one of a negative charge side and a positive charge side.

10 Claims, 12 Drawing Sheets

U.S. PATENT DOCUMENTS

| | | | |
|---|---|---|---|
| 2007/0280742 | A1 | 12/2007 | Matsumoto et al. |
| 2008/0063433 | A1 | 3/2008 | Miyamoto et al. |
| 2008/0063434 | A1 | 3/2008 | Uno et al. |
| 2009/0103935 | A1 | 4/2009 | Uno et al. |

FOREIGN PATENT DOCUMENTS

| | | | | |
|---|---|---|---|---|
| EP | 1 793 283 | A1 | | 6/2007 |
| JP | 60-18065 | | | 5/1985 |
| JP | 06067536 | A | * | 3/1994 |
| JP | 08110691 | A | * | 4/1996 |
| JP | 2001-324863 | | | 11/2001 |
| JP | 2004-29306 | | | 1/2004 |
| JP | 2004-323062 | | | 11/2004 |
| JP | 2004-333514 | | | 11/2004 |

* cited by examiner

FIG. 14

| | REMAINING MATERIAL AFTER REFILLING OPERATION | | |
|---|---|---|---|
| | PRE-MIXED TONER AMOUNT [g] | CARRIER AMOUNT [g] | REMAINING CONDITION |
| EXAMPLE 1 | 5.7 | 0.9 | ACCUMULATED AROUND EXIT PORT |
| EXAMPLE 2 | 4.9 | 0.4 | ACCUMULATED AROUND EXIT PORT |
| COMPARATIVE EXAMPLE 1 | 14.6 | 9.2 | ADHERED ON INNER LAYER WITH LARGER AMOUNT |
| EXAMPLE 3 | 2.6 | 0.5 | ACCUMULATED AROUND EXIT PORT |
| EXAMPLE 4 | 2.4 | 0.5 | ACCUMULATED AROUND EXIT PORT |
| EXAMPLE 5 | 1.6 | 0.1 | ACCUMULATED AROUND EXIT PORT |
| COMPARATIVE EXAMPLE 2 | 26.7 | 12.7 | ADHERED ON INNER LAYER WITH LARGER AMOUNT |

FIG. 15

| | INITIAL STAGE | | | AFTER PRINTING 100,000 SHEETS | | |
|---|---|---|---|---|---|---|
| | IMAGE CONCEN-TRATION | FOGGING | TRANSFER PERFOR-MANCE | IMAGE CONCEN-TRATION | FOGGING | TRANSFER PERFOR-MANCE |
| EXAMPLE 1 | 5 | 5 | 4 | 4 | 5 | 3 |
| EXAMPLE 2 | 5 | 5 | 4 | 4 | 5 | 3 |
| COMPARATIVE EXAMPLE 1 | 4 | 4 | 3 | 3 | 2 | 1 |
| EXAMPLE 3 | 4 | 4 | 3 | 4 | 3 | 3 |
| EXAMPLE 4 | 5 | 5 | 4 | 4 | 4 | 3 |
| EXAMPLE 5 | 5 | 5 | 5 | 5 | 5 | 4 |
| COMPARATIVE EXAMPLE 2 | 5 | 5 | 5 | 3 | 4 | 3 |

DEVELOPING AGENT STORAGE DEVICE AND IMAGE FORMING APPARATUS HAVING SAME IN WHICH THE CHARGEABILITY LEVEL OF THE TONER, STORAGE DEVICE, AND CARRIER HAVE A SPECIFIC RELATIONSHIP

CROSS-REFERENCE TO RELATED APPLICATIONS

This application claims priority from Japanese Patent Application Nos. 2007-123286, filed on May 8, 2007, 2007-316233, filed on Dec. 6, 2007, and 2008-034852, filed on Feb. 15, 2008 in the Japan Patent Office, the entire contents of each of which are hereby incorporated by reference herein.

BACKGROUND OF THE INVENTION

1. Field of the Invention

The present disclosure generally relates to a developing agent storage device containing refill developing agent consisting substantially of toner particles and carrier particles, and an image forming apparatus having such developing agent storage device.

2. Description of the Background Art

Recently, market demand has been growing for higher image quality for images with widespread use of full-color image forming apparatuses employing electrophotography. Such demand has been met by developing smaller-sized or smaller-diameter toner particles for use in such electrophotography.

However, a drawback of such smaller-sized toner particles is that they have a proportionally greater surface area, which makes a so-called toner spent phenomenon on carrier particles more likely to occur.

Further, with growing demand for size reduction of image forming apparatuses and higher speed printing, a smaller amount of developing agent is agitated at a higher speed in a developing unit, putting greater stress on the developing agent. Such greater stress may cause abrasion of coating layer of carrier particles, or toner spent on the carrier particles, which accelerates degradation of the carrier particles. If such degraded carrier is used as the developing agent, higher image quality cannot be obtained even if smaller-diameter toner particles are used.

Typically, an image forming apparatus includes a refill unit used for refilling a developing unit with toner particles. With such a configuration, toner particles consumed in the process of developing images can be replaced with fresh toner particles refilling the developing unit at a given time interval. By contrast, however, unlike the toner particles, the carrier particles in the developing unit are not replaced in such a configuration. Accordingly, to suppress image quality degradation due to degraded carrier particles, the developing agent in the developing unit needs to be replaced at short time intervals. However, such frequent replacement of developing agent increases maintenance cost, and results in an increase of printing cost.

One background art technique to suppress such increased maintenance cost and degradation of image quality caused by carrier particle degradation employs an image forming apparatus in which the developing unit is automatically refilled with refill carrier as well as toner particles. When refilling a given amount of the refill carrier to the developing unit, a given amount of used developing agent in the developing unit is ejected from the developing unit to replace used carrier with new carrier, in which the amount of the refill carrier and the ejected amount of used developing agent may be substantially identical. With such replacement, a ratio of degraded carrier in the developing unit can be set smaller, by which degradation of image quality caused by carrier degradation in the developing unit can be reduced or prevented. Further, if a ratio of degraded carrier in the developing unit can be reduced, a replacement frequency of developing agent used in the developing unit can be reduced, by which an increase of maintenance cost can be reduced or prevented.

However, such configuration requires a carrier storage unit for storing refill carrier and a carrier refill unit in addition to a toner storage unit for storing refill toner particles and a toner refill unit, which increases both the size and the cost of the image forming apparatus.

Another background art technique an image forming apparatus that includes a developing agent storage device storing a refill developing agent, prepared by mixing refill toner particles with refill carrier particles in advance, in which a toner concentration is set higher than a toner concentration in the developing agent used in the developing unit. Such developing agent storage device may be rotated, or the developing agent in the developing agent storage device may be agitated, to supply the refill developing agent to the developing unit. When refilling a given amount of the refill developing agent to the developing unit, a given amount of used developing agent in the developing unit is ejected from the developing unit to replace used carrier with new carrier, in which the amount of the refill developing agent and the ejected amount of used developing agent may be substantially identical. Because refill toner particles and refill carrier can be stored in a same storage device in such image forming apparatus, one common storage device and one common refill unit can be used for refilling both of toner and refill carrier. Accordingly, a size increase and cost increase of an image forming apparatus can be reduced or prevented.

In addition, a toner storage unit for storing refill toner particles may be made of transformable or volume reducible material so that a storage space of used toner storage unit at a user location can be minimized and transportation costs, such as cost of recovery from a user location, can be reduced or prevented.

Yet another background art technique involves stably ejecting toner particles from such toner storage unit and effectively supplying toner particles to a developing unit in an image forming apparatus. The image forming apparatus includes a toner refill unit having a powder pump for refilling the developing unit with toner particles, in which the powder pump sucks refill toner particles from the toner storage unit by applying negative pressure to the toner storage unit to transport sucked refill toner particles to the developing unit. When the powder pump applies negative pressure to the toner storage unit, refill toner particles can be discharged from a toner exit port of the toner storage unit. Then, such discharged refill toner particles are guided to and transported to the developing unit through transport route devices by the negative pressure provided by the powder pump.

When the refill toner particles are discharged from the toner exit port by such negative pressure, refill toner particles near the toner exit port are discharged to the outside of the toner storage unit and then refill toner particles far from the toner exit port move toward the toner exit port. In such toner storage unit, discharging of refill toner particles and movement of refill toner particles can be performed by a sucking effect of the powder pump, therefore eliminating the need for the toner storage unit to have a toner transport device for moving refill toner particles.

However, when toner particles and carrier particles are separately filled in a developing agent storage device such as the aforementioned volume reducible storage unit as refill developing agent, some drawbacks occur.

For example, depending on the way in which the carrier particles are put in the developing agent storage device, the carrier particles may not be discharged from the developing agent storage device, or only carrier particles are discharged from the developing agent storage device. If carrier particles remain in the developing agent storage device without being discharged, the developing unit is not effectively refilled with the carrier particles, and thereby degradation of developing agent cannot be reduced or prevented. Further, if only carrier particles are discharged from the developing agent storage device, carrier transport by a powder pump may be stopped, in which case carrier particles clog the transport route device even if negative pressure is applied.

In light of such drawbacks of filling a developing agent storage device with toner particles and carrier particles separately, a given amount of carrier particles can be mixed in with the toner particles in advance so that the developing agent, having uniformly dispersed toner and carrier particles therewithin, can be provided to a developing agent storage device. If such mixing process is conducted for every one of the developing agent storage devices, the aforementioned irregular discharge of carrier can be reduced or prevented.

However, for reasons of manufacturing efficiency and cost, such developing agent having pre-mixed toner and carrier particles is generally prepared in bulk. However, because the toner and carrier particles have different specific gravities they cannot be uniformly mixed in bulk. As a result, multiple developing agent storage devices manufactured from even the same bulk mixture of toner and carrier can have differences or variances in the amount carrier in each of developing agent storage devices. In extreme cases, some developing agent storage devices have no carrier. Obviously, such developing agent storage device cannot supply carrier to the developing unit, which results in degradation of the developing agent.

Accordingly, a developing agent storage device that can effectively and efficiently supply carrier to a developing unit used in an image forming apparatus is desired.

SUMMARY

In an aspect of the present disclosure, a developing agent storage device for storing a refill developing agent includes toner particles, carrier particles, an inner layer of the developing agent storage device. The toner particles and carrier particles compose the refill developing agent. The inner layer is provided as a wall contacting the refill developing agent. An electrostatic chargeability level of the toner particles, the carrier particles, and the inner layer is set in an order of toner, inner layer, and carrier from any one of a negative charge side and a positive charge side.

In another aspect of the present disclosure, an image forming apparatus includes a latent image carrier, a development unit, a developing agent refill device, and a developing agent storage device. The latent image carrier forms a latent image thereon. The development unit develops the latent image formed on the latent image carrier using a developing agent. The developing agent refill device refills the development unit with developing agent, an amount of refilling developing agent is substantially equal to an amount of developing agent consumed in the development unit. The developing agent storage device store refill developing agent to be refilled to the development unit, and the developing agent storage device is detachably mountable to the developing agent refill device. The developing agent storage device includes toner particles, carrier particles, an inner layer of the developing agent storage device. The toner particles and carrier particles compose the refill developing agent. The inner layer is provided as a wall contacting the refill developing agent. An electrostatic chargeability level of the toner particles, the carrier particles, and the inner layer is set in an order of toner, inner layer, and carrier from any one of a negative charge side and a positive charge side.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIGS. 14 and 15 show experiment results of performance of a pre-mixed toner refill unit and an image forming apparatus according to an exemplary embodiment.

Figure 1:
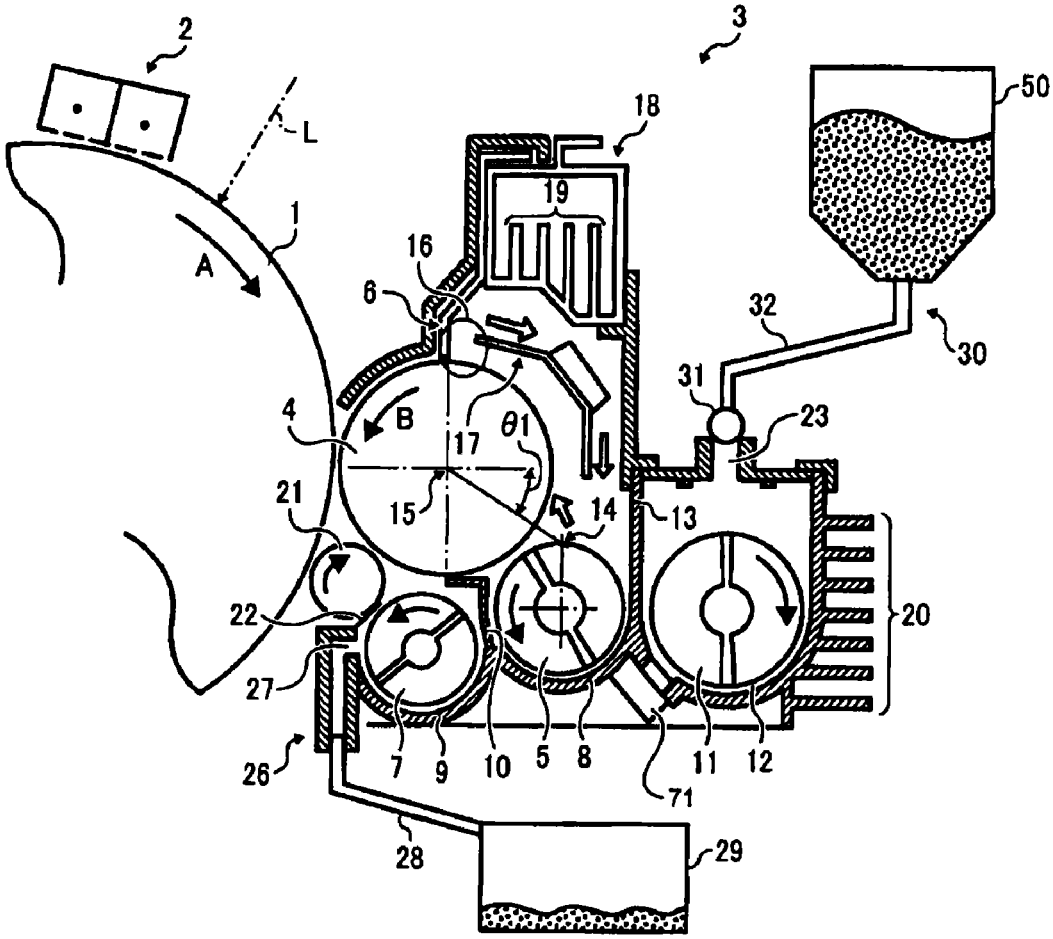
FIG. 1 illustrates a schematic configuration of a developing unit of an image forming apparatus according to an exemplary embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described with reference to accompanying drawings. The image forming apparatus may employ electrophotography, for example, but not limited thereto.

A description is now given to an image forming apparatus having a single developing unit to develop a single color image. Such image forming apparatus may have following configuration to conduct an image forming operation. However, the image forming apparatus may be disposed of a plurality of developing units for developing color images, for example.

FIG. 1 illustrates a schematic configuration of a developing unit and devices surrounding the developing unit in an image forming apparatus according to an exemplary embodiment. Such image forming apparatus includes a photoconductor 1, a charge unit 2, and a development unit 3, for example.

The photoconductor 1, used as latent image carrier and rotating in a direction shown by an arrow A, is uniformly charged by the charge unit 2 to a given potential, and then irradiated with a light beam L emitted from an optical writing unit (not shown) to form a latent image on the photoconductor 1. The light beam L is generated based on image data. The development unit 3 develops the latent image on the photoconductor 1 as a toner image using toner particles. The toner image on the photoconductor 1 is transferred to a transfer medium (not shown), such as transfer sheet, and the toner image is fixed on the transfer medium with a fixing unit (not shown) and output as an image printed sheet.

Figure 2:
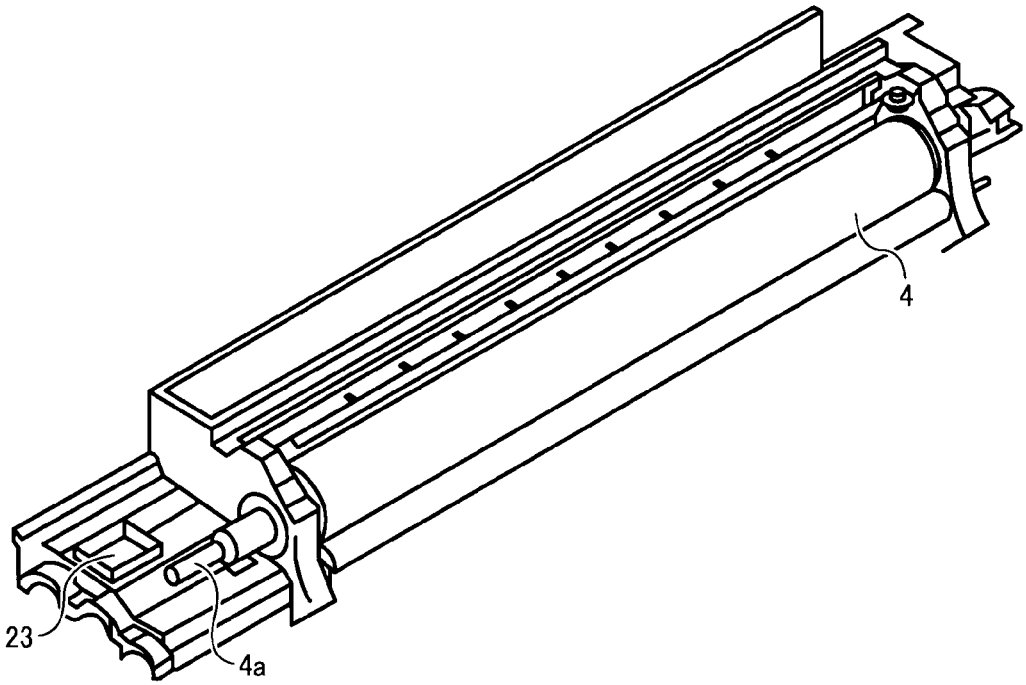
FIG. 2 illustrates a perspective view of the developing unit of FIG. 1.
Figure 3:
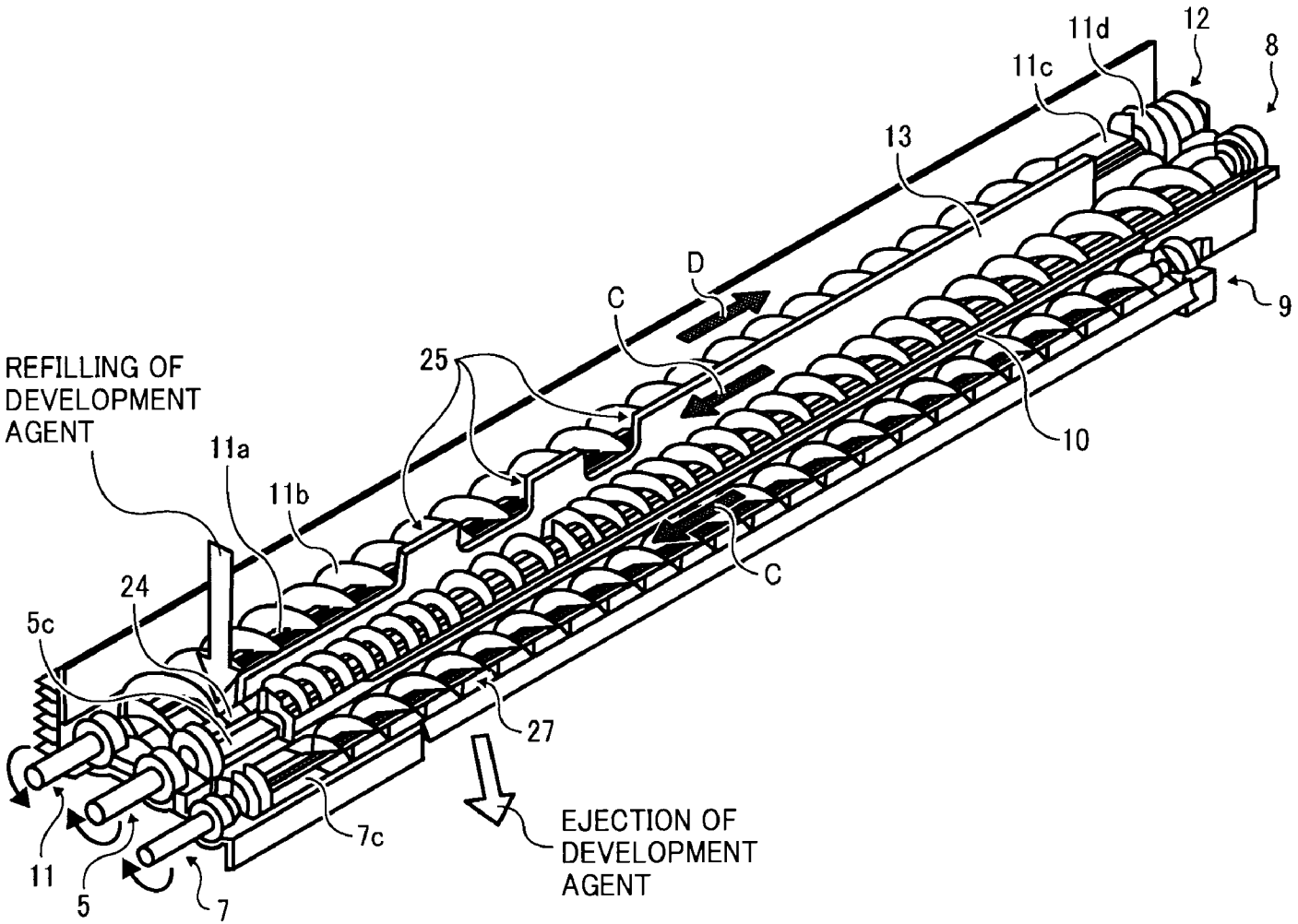
FIG. 3 illustrates a perspective view of the developing unit of FIG. 2, in which an upper casing is removed and a lower casing, used as transport route, and screws disposed in the transport route are shown.

The development unit 3 uses two-component developing agent having toner and carrier particles (hereinafter, referred to developing agent, as required) for developing images, for example. FIG. 2 illustrates a perspective view of the developing unit 3, and FIG. 3 illustrates a perspective view of the developing unit 3, in which an upper casing is removed and a lower casing, used as transport route, and screws disposed in the transport route are shown.

As illustrated in FIG. 1, the development unit 3 includes a developing roller 4, a supply screw 5, a doctor blade 6, a recovery screw 7, a supply compartment 8, a recovery compartment 9, and a separation wall 10, for example.

The developing roller 4 rotates in a direction shown by an arrow B in FIG. 1. The developing roller 4 carries the developing agent thereron, and supplies the developing agent to a latent image on the photoconductor 1 to develop the latent image as a toner image. The supply screw 5 transports the developing agent in one direction and supplies the developing agent to the developing roller 4. The doctor blade 16 regulates an amount or thickness of the developing agent to be carried on the developing roller 4. The recovery screw 7 recovers the developing agent not used for a developing process at a developing section and transports recovered developing agent in a same direction of the supply screw 5.

The supply compartment 8 having the supply screw 5 and the recovery compartment 9 having the recovery screw 7 are disposed in parallel each other under the developing roller 4. The supply compartment 8 and the recovery compartment 9 used as transport routes are separated each other by the separation wall 10. The supply compartment 8 and the recovery compartment 9 are connected each other at both end portions of the separation wall 10, at which an opening is provided to the separation wall 10 so that the developing agent can move through such opening. Accordingly, the developing agent can be circulated between the supply compartment 8 and the recovery compartment 9.

Further, an upper end of the separation wall 10 is distanced from a surface of the developing roller 4 with a given gap, preferably 1 mm or less in an exemplary embodiment. If the separation wall 10 contacts the developing roller 4, a greater load is required for rotating the developing roller 4, which is not preferable.

Further, the development unit 3 includes an agitation screw 11 and an agitation compartment 12, disposed next to the supply compartment 8. The agitation screw 11 agitatingly transports the developing agent in the agitation compartment 12 in a direction opposite to a transport direction in the supply compartment 8. The agitation compartment 12 and the supply compartment 8 are separated each other by a separation wall 13. The agitation compartment 12 and the supply compartment 8 are connected each other at both end portions of the separation wall 13, at which an opening is provided to the separation wall 13 so that the developing agent can move through such opening between the supply compartment 8 and the agitation compartment 12.

As shown in FIG. 1, the supply screw 5 has a top peripheral point 14, and the developing roller 4 has a center 15. The supply screw 5 is preferably provided at a given position so that a first straight line, extending from the center 15 of the developing roller 4 to the top peripheral point 14 of the supply screw 5, and a second straight line, extending from the center 15 of the developing roller 4 in a horizontal direction, form an angle $\theta_1$ of 30 degrees. The angle $\theta_1$ is preferably set in a range of from 10 degrees to 40 degrees to reduce a size of the development unit 3 although a diameter of the supply screw 5 may need to be considered for setting the angle $\theta_1$. With such configuration, the top peripheral point 14 of the supply screw 5 comes below the center 15 of the developing roller 4.

The developing roller 4 attracts carrier particles in the developing agent using magnetic force of magnetic poles disposed in the developing roller 4. With the aforementioned configuration that the top peripheral point 14 of the supply screw 5 is placed below the center 15 of the developing roller 4, self weight of the developing agent may not effect supplying the developing agent to the developing roller 4, but a magnetic force strength of the developing roller 4 effects supplying the developing agent to the developing roller 4. With such configuration, the amount of the developing agent to be supplied to the developing roller 4 can be controlled by the magnetic force strength of the developing roller 4. Accordingly, the developing agent can be effectively supplied to the developing roller 4 from an upper portion of the developing agent, transported in the supply compartment 8. Therefore, a desired amount of the developing agent can be supplied to the developing roller 4 from the supply compartment 8 even if the developing agent in the supply compartment 8 has some uneven height along a transport direction in the supply compartment 8.

Figure 4:
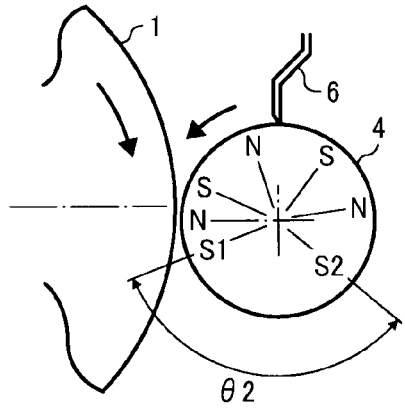
FIG. 4 illustrates a schematic cross-sectional view of a developing roller of the developing unit of FIG. 1, which shows magnetic pole positions.

FIG. 4 illustrates a schematic view of the developing roller 4 showing positions of magnetic poles. As illustrated in FIG. 4, the developing roller 4 has a first pole S1, and a second pole S2. The first pole S1 is positioned at a most downstream of a surface movement direction of the developing roller 4 in the developing section, and the second pole S2 is positioned so as to face the supply screw 5. Further, the developing roller 4 has no magnetic poles between the first pole S1 and the second pole S2 as shown in FIG. 4, and the recovery compartment 9 is positioned below such non-magnetic pole area. Such non-magnetic pole area is used as recovery area for recovering the developing agent used for a developing process to the recovery compartment 9. When the developing agent is transported to the recovery area after a developing process, the developing agent may not be attracted on the developing roller 4 by magnetic force, and then drop from the developing roller 4 to the recovery compartment 9 with an effect of centrifugal force of the developing roller 4 and self weight of the developing agent, by which the developing agent is recovered in the recovery compartment 9. With such configuration, used developing agent having a smaller toner concentration may not be transported to the supply compartment 8 and not used for another developing process. The first and second poles S1 and S2 may preferably form an angle $\theta_2$ of 100 degrees or more to prevent an intrusion of used developing agent to the supply compartment 8.

Further, the developing agent supplied on the surface of the developing roller 4 from the supply compartment 8 is regulated by the doctor blade 6 to set thickness of the developing agent on the developing roller 4 at preferable level to effectively perform a developing process.

Because such preferable thickness of the developing agent is set by regulating an amount of the developing agent by the doctor blade 6, an amount of the developing agent supplied to the developing roller 4 may become greater compared to an amount of the developing agent that moves past the doctor blade 6. As illustrated in FIG. 1, the developing agent is regulated at a doctor area 16, which is an upstream side of the doctor blade 6. Accordingly, when the developing agent is regulated by the doctor blade 6, the regulated developing agent may accumulate on the doctor area 16. Such accumulated developing agent may be pushed up by another developing agent, coming to the doctor area 16 at a later time, and drop and return to the doctor area 16, which may mean that regulated developing agent circulates on or over the doctor area 16. The development unit 3 includes an agent adjusting member 17 to prevent an accumulation of the regulated developing agent at the doctor area 16. Specifically, when an amount of the regulated developing agent exceeds a given level, the developing agent may be returned to the supply compartment 8 via the agent adjusting member 17. The agent recovery member 17 is positioned so that developing agent, returning to the supply compartment 8, does not receive an effect of magnetic attraction force of the developing roller 4. If the developing agent returning to the supply compartment 8 receives magnetic attraction force of the developing roller 4, such developing agent may be remained on the agent recovery member 17, which is not preferable.

Further, the doctor blade 6 is fixed to a heat release unit 18 fixed to a casing of the development unit 3. Accordingly, heat generated in the developing agent can be transferred to the heat release unit 18 via the doctor blade 6. The heat release unit 18 has fins 19 in its interior, and heat radiation may be conducted by airflow. With such configuration, temperature increase of developing agent in the development unit 3 can be reduced or prevented. Further, the development unit 3 includes a heat radiation fin 20 on its casing, which is cooled by supplying cooling air to the development unit 3. With such configuration, temperature increase of the development unit 3 can be reduced or prevented.

Further, the development unit 3 includes an agent catch roller 21 at a position facing a downstream of the developing section of the developing roller 4. The agent catch roller 21 catches magnetic carrier adhering on the photoconductor 1 and the developing agent dropped from the developing roller 4. The agent catch roller 21 rotates in a counter direction with respect to the developing roller 4, and supplies the cached magnetic carrier or developing agent to the developing roller 4, or to the recovery compartment 9 using a scraper 22.

A description is now given to a circulation of developing agent in the transport routes 8, 9, and 12 of the development unit 3. In the development unit 3, the supply compartment 8, recovery compartment 9, and agitation compartment 12 have a function of transport routes for transporting a developing.

As illustrated in FIG. 3, in the development unit 3, excessive developing agent, not used for a developing process, is transported in the supply compartment 8 by the supply screw 5 in a direction shown by an arrow C, and recovered developing agent is transported in the recovery compartment 9 by the recovery screw 7 in a direction shown by an arrow C. Such excessive developing agent and recovered developing agent are then transported to the agitation compartment 12.

In the agitation compartment 12, the excessive developing agent and recovered developing agent are transported in a direction shown by an arrow D, opposite to the direction shown by the arrow C, by using the agitation screw 11. Accordingly, the developing agent is agitatingly transported in the agitation compartment 12 in the direction, opposite to the transport direction in the supply compartment 8 and the recovery compartment 9. Then, the developing agent moves from the downstream end of the agitation compartment 12 to the upstream end of the supply compartment 8.

The development unit 3 may include a toner concentration sensor 71 under the agitation compartment 12. Based on a signal from the toner concentration sensor 71, a pre-mixed toner refill unit 30 is activated to supply a developing agent having fresh toners and carriers to the development unit 3. Such developing agent having fresh toners and carriers is referred as pre-mixed toner in this disclosure, which will be described later.

The pre-mixed toner refill unit 30 refills the pre-mixed toner to any one of the transport routes 8, 9, and 12 through a toner supply port 23, which is disposed over the agitation screw 11 and an outside of the developing section as illustrated in FIG. 2. The pre-mixed toner, refilled from the toner supply port 23, is received at an agent receiving section 24 illustrated in FIG. 3. At the agent receiving section 24, the developing agent moves from the supply compartment 8/recovery compartment 9 to the agitation compartment 12. Because the developing agent can be agitated intensively at the agent receiving section 24, the pre-mixed toner can be agitated intensively right after refilling the pre-mixed toner to the agent receiving section 24, by which frictional electrification of toner particles can be enhanced. Accordingly, the pre-mixed toner can be transported to the supply compartment 8 after effectively enhancing a charging level of the pre-mixed toner, and then such effectively charged toner can be supplied to the developing roller 4.

As illustrated in FIG. 2, a rotation shaft 4*a* of the developing roller 4 is extended over a space, which is over an end portion between the recovery compartment 9 and the supply compartment 8, and a drive unit (not shown) for driving the rotation shaft 4*a* may be disposed to such space. When such drive unit is disposed to such space, the toner supply port 23 cannot be provided to the end portion between the recovery compartment 9 and the supply compartment 8. If such drive unit can be disposed at another position, the toner supply port 23 can be provided to the end portion between the recovery compartment 9 and the supply compartment 8. If the pre-mixed toner can be refilled at the end portion between the recovery compartment 9 and the supply compartment 8, recovered developing agent having a lower toner concentration can be mixed with the pre-mixed toner having higher toner concentration, by which toner concentration in the developing agent used in the development unit 3 can be efficiently maintained at a stable level.

A description is given to a configuration of the screws 5, 7, and 11 using the agitation screw 11. As illustrated in FIG. 3, the agitation screw 11 includes a rotation shaft 11*a*, a vane 11*b*, a paddle 11*c*, and a reverse vane 11*d*. The vane 11*b*, winded along the rotation shaft 11*a*, is used to agitatingly transport the developing agent in one direction, and the paddle 11*c* is used to move the developing agent to the supply screw 5, adjacently disposed to the agitation screw 11. The reverse vane 11*d*, attached next to the paddle 11*c*, has a vane winded in a direction opposite to the winded direction of the vane 11*b*. Such reverse vane 11*d* transports the developing agent in a direction, opposite to the transport direction of the developing agent in the agitation compartment 12, by which the developing agent is not fed to a bearing portion provided at the downstream end of the agitation screw 11. The supply screw 5 and the recovery screw 7 are configured similarly as the agitation screw 11.

As above described, the agitation compartment 12 and the supply compartment 8 are communicated with each other at the downstream side of transport direction of the agitation compartment 12 and the upstream side of transport direction of the supply compartment 8 via the opening of the separation wall 13. Specifically, the developing agent transported to the downstream side of transport direction of the agitation compartment 12 moves to the upstream side of transport direction of the supply compartment 8 with a rotation of the paddle 11*c* of the agitation screw 11.

As above described, the supply compartment 8, the recovery compartment 9, and the agitation compartment 12 are communicated with each other at the downstream side of transport direction of the supply compartment 8/recovery compartment 9 and the upstream side of transport direction of the agitation compartment 12 via openings of the separation wall 13 and the separation wall 10. The recovered developing agent in the recovery compartment 9 moves to the supply compartment 8 with a rotation of a paddle 7*c* of the recovery screw 7. Then, such recovered developing agent is mixed with the excessive developing agent transported to the downstream side of transport direction of the supply compartment 8. Such mixed excessive developing agent and recovered developing agent moves to the agitation compartment 12 with a rotation of a paddle 5*c* of the supply screw 5.

As above described, the development unit 3 includes the supply screw 5 (in the supply compartment 8), the recovery screw 7 (in the recovery compartment 9), and the agitation screw 11 (in the agitation compartment 12), which are arranged side by side below the developing roller 4 to circulate the developing agent, in which the supply compartment 8, the recovery compartment 9, and the agitation compartment 12 are also used as transport routes of the developing agent. Accordingly, the developing agent moves among the transport routes 8, 9, and 12 in a substantially horizontal direction, and thereby the developing agent is not circulated in a vertical direction. Such horizontal direction circulation of the developing agent can reduce stress to the developing agent compared to circulating the developing agent in the vertical direction, by which a lifetime of developing agent can be enhanced. Further, the transport routes 8, 9, and 12 are communicated with each other at the downstream end of the transport direction of the supply screw 5/recovery screw 7 and the upstream end of the transport direction of the agitation screw 11. Accordingly, the recovered developing agent and excessive developing agent can be moved to the agitation compartment 12 with such simpler configuration.

Conventionally, when to move a developing agent from one transport route to adjacent another transport route in a substantially horizontal direction, a force is applied to the developing agent, coming to the downstream end of the transport direction of the one transport route, in which the force is applied in a direction parallel to an axis direction of the transport route. With such force application, the developing agent accumulated at the downstream end of the transport direction is pushed by such force and then spilled over from one transport route to the adjacent another transport route via an opening of a separation wall set between the two transport routes. However, such configuration may apply too great force to the developing agent so that the developing agent may receive too great stress, by which a lifetime of the developing agent may become short.

In contrast, in an exemplary embodiment, the development unit 3 uses a paddle, disposed at the downstream end of the transport direction of the transport routes, to move the developing agent among the transport routes by applying a force in a direction transversal to the transport direction. Accordingly, such configuration can move the developing agent with reduced force, and thereby the developing agent may receive less stress compared to the aforementioned conventional configuration.

Further, as illustrated in FIG. 3, the separation wall 13 separating the supply compartment 8 and the agitation compartment 12 has an agent height adjustment opening 25. The agent height adjustment opening 25 may be disposed at a position corresponding a relatively downstream portion of the transport direction of the supply screw 5. When the developing roller 4 stops or when the developing agent amount used for a developing process is decreased due to a setting of the doctor blade 6, a height of the developing agent in the supply compartment 8 becomes higher than a desired level. If such height increase of developing agent occurs, the supply screw 5 cannot transport the developing agent with a preferred condition. For example, the developing agent may not be transported efficiently, or the developing agent may not be circulated under a normal condition, resulting into degradation of the developing agent.

In an exemplary embodiment, when the developing agent height in the supply compartment 8 becomes higher than a desired level, the developing agent overflows to the agitation compartment 12 from the supply compartment 8 via the agent height adjustment opening 25. Accordingly, the developing agent height at the relatively downstream portion of the transport direction of the supply compartment 8 can be maintained at the desired level. The overflowed developing agent has a preferable toner concentration for a developing process because the developing agent is overflowed from the supply compartment 8. Accordingly, even if the developing agent is overflowed to the agitation compartment 12, the developing agent in the agitation compartment 12 has a good level of toner concentration and uniform toner concentration.

As illustrated in FIG. 3, the agent height adjustment opening 25 can be disposed at a plurality of positions, or one single agent height adjustment opening 25, extending along a relatively downstream portion of the transport direction of the supply compartment 8, can be disposed.

The above described configuration for overflowing the developing agent from the supply compartment 8 to the agitation compartment 12 through an opening set at a given height of the separation wall 13 can be configured because the supply compartment 8 and the agitation compartment 12 are arranged sided by side at a substantially same height. If an agitation compartment is arranged over a supply compartment in a vertical direction, the developing agent overflowed from the supply compartment may not be moved to the agitation compartment. If an agitation compartment is arranged below a supply compartment in a vertical direction, a route for dropping overflowed developing agent to the agitation compartment may be in need, which may result into a complex configuration of a developing unit.

In an exemplary embodiment, because the supply compartment 8 and the agitation compartment 12 are arranged side by side at a substantially same height, the developing agent can be overflowed from the supply compartment 8 to the agitation compartment 12 by setting an opening at a given height of the separation wall 13, which is a relatively simple configuration.

A description is now given to a configuration and an ejection process of used developing agent from the development unit 3. As illustrated in FIG. 1, the development unit 3 includes an agent ejector 26 used for ejecting the developing agent from the development unit 3. The agent ejector 26 includes an agent ejection port 27, an ejection route 28, and an agent container 29. The developing agent ejected from the ejection port 27 is transported to the agent container 29 via the ejection route 28.

In an exemplary embodiment, the pre-mixed toner refill unit 30 refills toner particles and carrier particles to the development unit 3, by which a toner concentration of the developing agent in the development unit 3 can be maintained at a given toner concentration value. However, a total amount of the developing agent in the development unit 3 increases for about a refill amount of carrier particles. In an exemplary embodiment, a total amount of the developing agent in the development unit 3 can be maintained at a given level by gradually ejecting a portion of the developing agent in the development unit 3 using the agent ejector 26.

The agent ejection port 27 is an opening provided at a given height from a bottom face of the recovery compartment 9. Specifically, when the total amount of the developing agent in the development unit 3 is set to a normal amount, the upper face of the developing agent in the recovery compartment 9 and the lower face of the agent ejection port 27 become a substantially same height.

If the total amount of the developing agent in the development unit 3 exceeds the normal amount by a refilling operation of the pre-mixed toner refill unit 30, the developing agent in the recovery compartment 9 increases its height to the height of the agent ejection port 27, and excessive developing agent overflows from the agent ejection port 27. Accordingly, an excessive amount of developing agent exceeding the normal amount by a refilling operation of the pre-mixed toner refill unit 30 can be ejected from the agent ejection port 27. Such ejected developing agent is stored in the agent container 29 via the ejection route 28. The ejection route 28 may be a tube having a screw therein to transport the developing agent to the agent container 29, or a tube for dropping the developing agent to the agent container 29 using gravity.

In an exemplary embodiment, the agent ejection port 27 is disposed in the recovery compartment 9 to eject the developing agent in the recovery compartment 9, wherein the developing agent to be ejected from the agent ejection port 27 is "used developing agent," which has moved past the developing section and has consumed toner particles during a developing process. Accordingly, such used developing agent has a toner concentration, which is significantly lower than other developing agent contained in other location in the development unit 3.

When ejecting the developing agent, it is preferable to eject only carrier particles from the development unit 3. Toner particles in development unit 3 are consumed during a developing process, and new toner particles are refilled by a refilling operation to replenish the consumed toner particles. Accordingly, most of toner particles existing in the development unit 3 have a good level of toner property or performance. If such toner particles are ejected with carrier particles when ejecting the developing agent, toner particles still having a good property are wastefully ejected, which is not preferable from a viewpoint of economical cost. Therefore, it is ideal to eject only carrier particles from the development unit 3. However, separation of carrier particles from toner particles, which are mixed together, are too difficult, and such separation may need a too-complex configuration even if it is possible.

In an exemplary embodiment, the developing agent, ejected from the recovery compartment 9, has a lower toner concentration compared to the developing agent located in other location in the development unit 3. Accordingly, an amount of toner particles ejected with carrier particles can be reduced or prevented, by which a wasteful ejection of toner particles, still having a good property, can be reduced or prevented.

In an exemplary embodiment, the agent ejection port 27 may be disposed at a downstream side of transport direction in the recovery compartment 9 as illustrated in FIG. 3, for example.

In the downstream end of transport direction in the recovery compartment 9, the recovered developing agent moves to the supply compartment 8 from the recovery compartment 9. When a continuous printing operation is conducted, the developing agent is continuously recovered from the developing roller 4. During such continuous printing operation, an amount of the recovered developing agent transported to the downstream end of the recovery compartment 9 by the recovery screw 7 may exceed an amount of the developing agent to be moved to the supply compartment 8. In such a case, the recovered developing agent accumulates at the downstream end of the recovery compartment 9. If such accumulated amount of developing agent becomes too great, the recovered developing agent may undesirably contact the surface of the developing roller 4. If the recovered developing agent contacts the surface of the developing roller 4, such recovered developing agent having a lower toner concentration may be carried on the developing roller 4 and transported to the supply compartment 8, and resultantly used for a developing process. In such a case, toner concentration of the developing agent transported to the developing section by the developing roller 4 becomes lower or non-uniform.

In an exemplary embodiment, as illustrated in FIG. 3, the agent ejection port 27 is disposed proximity to the downstream end of transport direction in the recovery compartment 9 as illustrated in FIG. 3. Accordingly, before the recovered developing agent is accumulated at the downstream end of the recovery compartment 9 too great amount, which may cause undesirable contact of recovered developing agent to the surface of the developing roller 4, the recovered developing agent can be ejected form the agent ejection port 27. Accordingly, such recovered developing agent having a lower toner concentration may not be carried on the developing roller 4 and transported to the supply compartment 8.

In an exemplary embodiment, the agent ejection port 27 is disposed at a side face of the recovery compartment 9 to eject the developing agent exceeding the normal amount of the developing agent in the development unit 3. However, other configurations can be devised for such ejection process. For example, an ejection port can be disposed on a bottom face of the recovery compartment 9 with a shutter, which can be opened and closed. Such shutter is controlled to eject the developing agent. In such a configuration, the shutter is operated for a given time based on a refill amount of the pre-mixed toner by the pre-mixed toner refill unit 30. With such shutter controlling, a refill amount of refill developing agent and an ejection amount of used developing agent can be substantially balanced to a same amount.

Further, in an exemplary embodiment, the developing agent ejected from the agent ejection port 27 may not include fresh developing agent, which is just refilled in the developing unit 3. The pre-mixed toner, refilled from the toner supply port 23, firstly transported in the agitation compartment 12, and secondly transported in the supply compartment 8, from which supplied to the developing roller 4 and used at the developing section, and thirdly recovered in the recovery compartment 9. Accordingly, the developing agent ejected from the agent ejection port 27 is used at least one time for a developing process. Therefore, in an exemplary embodiment, fresh developing agent, which is just refilled in the developing unit 3, may not be wastefully ejected from the agent ejection port 27.

Figure 5:
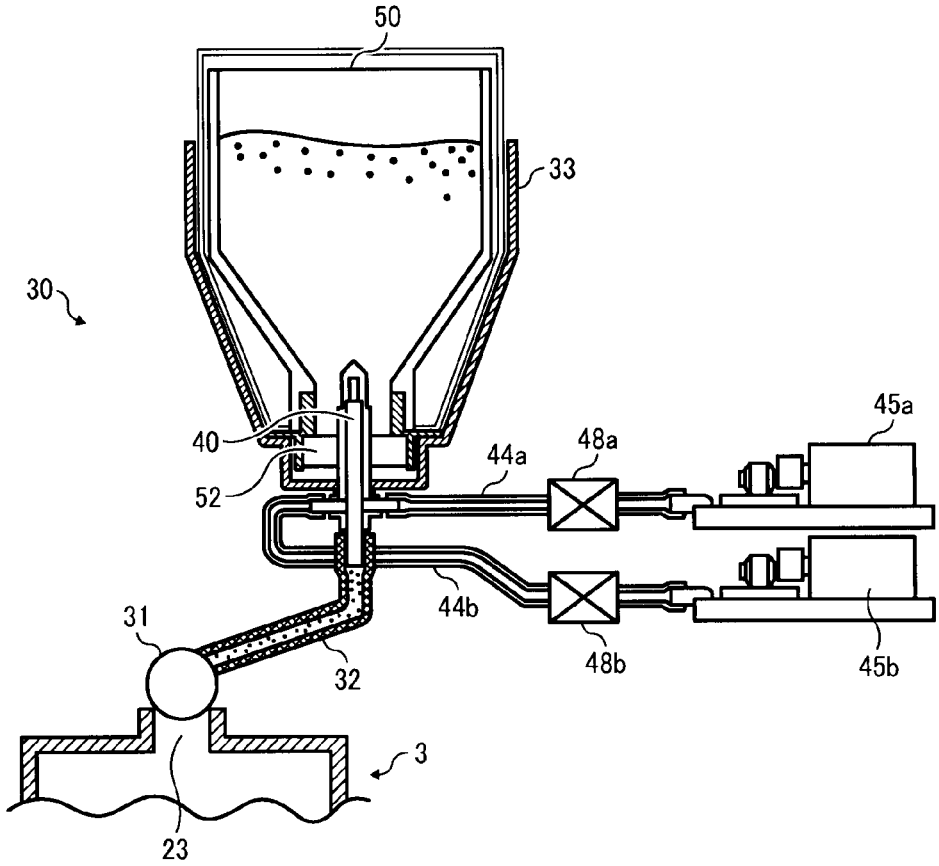
FIG. 5 illustrates a schematic configuration of a pre-mixed toner refill unit used for the developing unit of FIG. 1.

A description is now given to a configuration and operation of the pre-mixed toner refill unit 30 according to exemplary embodiment with reference to FIG. 5. FIG. 5 illustrates a schematic configuration of the pre-mixed toner refill unit 30. As illustrated in FIG. 5, the pre-mixed toner refill unit 30 includes a mohno pump 31, and a transport tube 32, for example. The mohno pump 31 is coupled to the toner supply port 23 of the development unit 3, and the transport tube 32 is coupled to the mohno pump 31 as a tube for transporting the agent. The transport tube 32 may be preferably formed of rubber material having flexibility and good toner-resistance performance, such as polyurethane, nytril, and EPDM (ethylene propylene diene rubber).

Further, the pre-mixed toner refill unit 30 includes a nozzle 40, and a container holder 33 for setting a pre-mixed toner container 50 to the pre-mixed toner refill unit 30. The pre-mixed toner container 50 is used as a developing agent storage device, and the nozzle 40 is used to couple the pre-mixed toner container 50 and the transport tube 32. The container holder 33 supports the pre-mixed toner container 50. The container holder 33 may be made of a material having a higher stiffness, such as resin.

Figure 6:
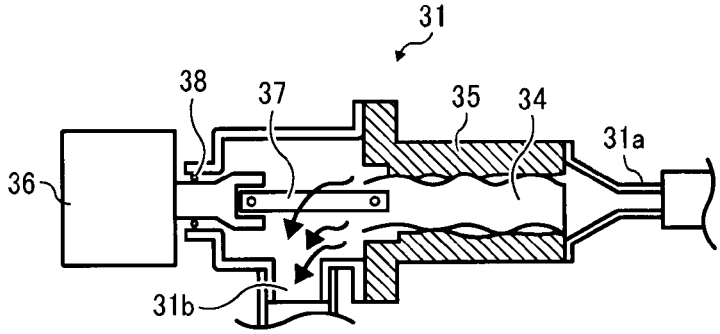
FIG. 6 illustrates a schematic cross-sectional view of a mohno-pump used for the pre-mixed toner refill unit of FIG. 5.

FIG. 6 illustrates a schematic cross-sectional view of the mohno-pump 31 used as a screw pump having an eccentric shaft. As illustrated in FIG. 6, the mohno pump 31 includes a rotor 34, and a stator 35. The rotor 34 is made of a hard material and formed in a helical shape in its cross sectional shape. The rotor 34 is engaged inside the stator 35. Further, the rotor 34 is coupled to a drive motor 36 via a universal joint 37 and a bearing 38. The drive motor 36 drives the rotor 34. The stator 35 is made of a flexible material, such as rubber, and formed in a helical shaped hole, to which the rotor 34 is engaged. A helical pitch of the stator 35 is set a twice length of a helical pitch of the rotor 34, for example.

In such configured mohno pump 31, when the drive motor 36 rotates the rotor 34, a suction pressure is generated in a helical space formed between the rotor 34 and the stator 35, by which negative pressure is generated in the transport tube 32. With such negative pressure generation, the pre-mixed toner in the pre-mixed toner container 50 is sucked to the mohno pump 31 via the transport tube 32 and a sucking port 31*a*. Then, the pre-mixed toner moves past the helical space formed between the rotor 34 and the stator 35, and drops from an exit port 31*b*, and then enter the development unit 3 via the toner supply port 23.

Further, when the mohno pump 31 is used, a transport route connecting the development unit 3 and the pre-mixed toner container 50 can be bended. Accordingly, compared to a straight transport route using a transport screw or the like, the development unit 3 and the pre-mixed toner container 50 can be positioned with less constrain on layout design, by which an internal design of an image forming apparatus can be selected from a variety of layout designs. Further, because the pre-mixed toner container 50 can be distanced from the development unit 3, the development unit 3 can be reduced in size. Further, the drive motor 36 is connected to a clutch (not shown). By controlling the clutch movement, a refill amount of the pre-mixed toner (or fresh developing agent) can be adjusted precisely.

Figure 7A:
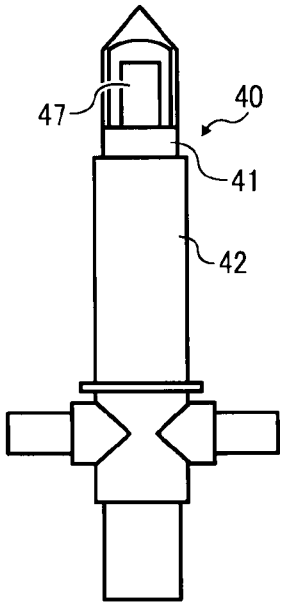
FIG. 7A illustrates a nozzle of the pre-mixed toner refill unit of FIG. 5.
Figure 7B:
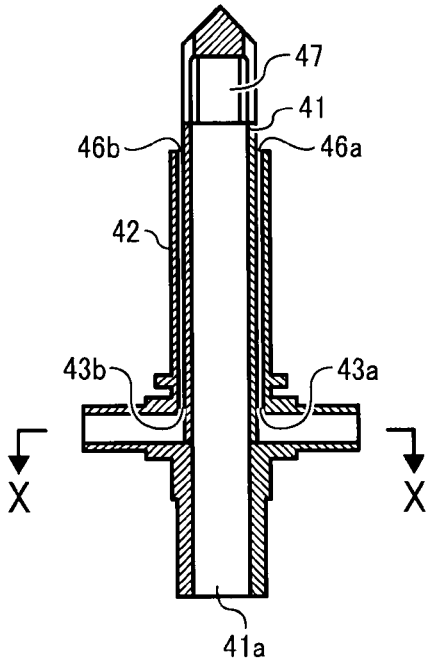
FIG. 7B illustrates a schematic cross-sectional view of the nozzle of FIG. 7A cut along an axial direction.
Figure 7C:
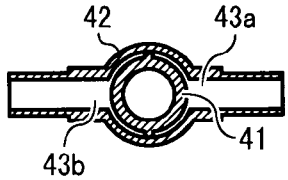
FIG. 7C illustrates a schematic cross-sectional view of the nozzle of FIG. 7B cut along a line of X-X.

FIG. 7A illustrates the nozzle 40 of the pre-mixed toner refill unit 30, FIG. 7B illustrates a schematic cross-sectional view of the nozzle 40 cut along an axial direction, and FIG. 7C illustrates a schematic cross-sectional view of the nozzle 40 cut along the line of X-X in FIG. 7B. As illustrated in FIGS. 7A to 7C, the nozzle 40 includes an inner tube 41 and an outer tube 42, in which the outer tube 42 encases the inner tube 41 to form a double tube construction. The inner tube 41 includes an agent flow route 41*a* therein to transport a refill developing agent or pre-mixed toner, discharged from the pre-mixed toner container 50. The refill developing agent in the pre-mixed toner container 50 is sucked to the mohno pump 31 via the agent flow route 41*a* with a sucking force effect of the mohno pump 31.

Further, as illustrated in FIG. 7B, the nozzle 40 includes a gas flow route 43 between the inner tube 41 and the outer tube 42 as a route for supplying gas, such as air. As illustrated in FIG. 7C, the gas flow route 43 includes flow routes 43*a* and 43*b* having a half-moon shape in cross-section, disposed separately. Each of the gas flow routes 43*a* and 43*b* is connected to gas pumps 45*a* and 45*b* via gas supply routes 44*a* and 44*b* as illustrated in FIG. 5.

The gas pumps 45*a* and 45*b* may be a diaphragm air pump, for example. The gas pumps 45*a* and 45*b* feed air, for example, to the pre-mixed toner container 50 through the gas flow routes 43*a* and 43*b* and gas supply ports 46*a* and 46*b*. Each of the gas supply ports 46*a* and 46*b* is positioned below an agent exit port 47 of the agent flow route 41*a*. With such configuration, air can be supplied to the pre-mixed toner near the agent exit port 47 from each of the gas supply ports 46*a* and 46*b*. Accordingly, even if the agent exit port 47 is clogged by the developing agent when an image forming apparatus is left for unused condition for a longer period of time, such air supply from the gas supply ports 46*a* and 46*b* can break such clogged pre-mixed toner existing near or around the agent exit port 47.

Further, each of the gas supply routes 44*a* and 44*b* includes valves 48*a* and 48*b*, which can be opened and closed using a control signal transmitted from a controller (not shown). When the valves 48*a* and 48 receive an ON signal from the controller, the valves are opened to flow air, and when the valves 48*a* and 48 receive an OFF signal from the controller, the valves are closed to stop an airflow.

The pre-mixed toner refill unit 30 activates a refilling operation of developing agent or pre-mixed toner when the controller receives a signal indicating a lower toner concentration from the toner concentration sensor 71.

In such refilling operation, the gas pumps 45*a* and 45*b* is activated to supply an airflow to the pre-mixed toner container 50, and the drive motor 36 is activated to drive the mohno pump 31 to suck and transport the pre-mixed toner.

An airflow, supplied by the gas pumps 45*a* and 45*b*, goes through the gas supply routes 44*a* and 44*b*, the gas flow routes 43*a* and 43*b* of the nozzle 40, and the gas supply ports 46*a* and 46*b*, and then enters the pre-mixed toner container 50. With such airflow, the pre-mixed toner in the pre-mixed toner container 50 is effectively agitated, by which the pre-mixed toner can be effectively fluidized.

Further, when such airflow is supplied in the pre-mixed toner container 50, an internal pressure of the pre-mixed toner container 50 increases. Therefore, the internal pressure of the pre-mixed toner container 50 and an external pressure (or atmosphere pressure) have a pressure difference, by which fluidized developing agent can be attracted to one direction generated by such pressure difference. With such pressure difference, the developing agent in the pre-mixed toner container 50 exits from the agent exit port 47. In an exemplary embodiment, a suction force by the mohno pump 31 also used to exit the developing agent from the pre-mixed toner container 50 via the agent exit port 47.

The pre-mixed toner, exited from the pre-mixed toner container 50, moves to the mohno pump 31 via the nozzle 40, the agent flow route 41*a*, and the transport tube 32. Then, the pre-mixed toner moves in the mohno pump 3, and drops from the exit port 31*b* to the toner supply port 23 of the development unit 3 to refill the pre-mixed toner to the development unit 3.

After refilling a given amount of developing agent, the controller stops the gas pumps 45*a* and 45*b* and the drive motor 36, and closes the valves 48*a* and 48*b* to complete a refilling operation. By closing valves 48*a* and 48*b* after completing one refilling operation, a blow back of pre-mixed toner from the pre-mixed toner container 50 to the gas pumps 45*a* and 45*b* via the gas flow routes 43*a* and 43*b* of the nozzle 40 can be prevented.

Further, an airflow amount supplied from the gas pumps 45*a* and 45*b* is set smaller than a suction amount of developing agent and suction airflow by the mohno pump 31. Accordingly, as pre-mixed toner is consumed, an internal pressure of the pre-mixed toner container 50 can be decreased. Because the pre-mixed toner container 50 is made of a flexible material, such as flexible sheet, in an exemplary embodiment, to be described later, the pre-mixed toner container 50 can reduce its volume as the internal pressure decreases.

Figure 8A:
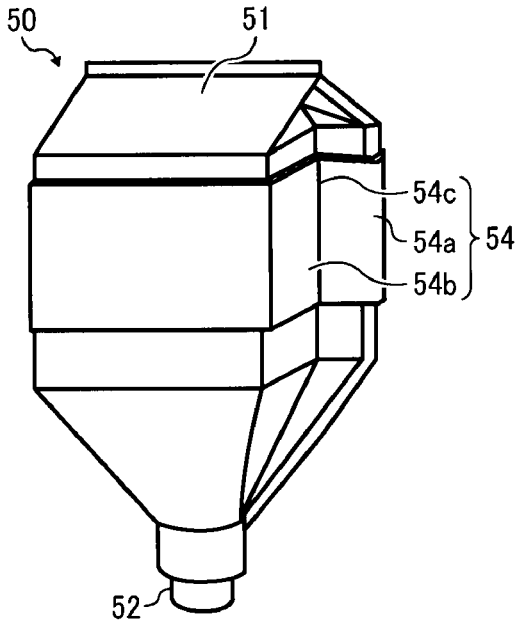
FIG. 8A illustrates a pre-mixed toner storage unit filled with pre-mixed toner particles.
Figure 8B:
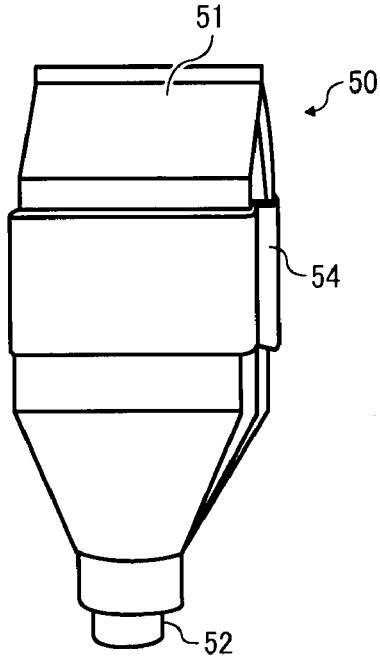
FIG. 8B illustrates a pre-mixed toner storage unit, which consumed pre-mixed toner particles.

A description is now given to the pre-mixed toner storage unit 50 according to an exemplary embodiment with reference to FIGS. 8A and 8B. FIG. 8A illustrates the pre-mixed toner storage unit 50 filled with the pre-mixed toner before use, and FIG. 8B illustrates the pre-mixed toner storage unit 50 after exiting the pre-mixed toner (i.e., after use).

The pre-mixed toner container 50 is configured with a container package 51, and a mouthpiece 52, for example. The container package 51 for storing a developing agent, is formed of a flexible sheet material, which is volume reducible with an effect of change of internal pressure or external pressure as above described. The mouthpiece 52 is used as a port of ejecting developing agent. The mouthpiece 52 is fused to an opening of the pre-mixed toner container 50. Such fusing method is preferably used for enhancing sealing performance of the pre-mixed toner container 50, but other methods can be used.

The mouthpiece 52 includes a seal member (not shown) having a crisscross incision. The nozzle 40 is inserted to the crisscross incision of the mouthpiece 52 to couple the pre-mixed toner container 50 and the pre-mixed toner refill unit 30. The pre-mixed toner container 50 is replaced with new one when the development agent substantially exits from the pre-mixed toner container 50 entirely. Such coupling or fixing configuration of the mouthpiece 52 can facilitate a removal/attachment operation of the pre-mixed toner container 50, and prevent toner spillover when using or replacing the pre-mixed toner container 50.

Further, the pre-mixed toner container 50 includes a guide member 54, which facilitates a shape transformation of the pre-mixed toner container 50 when the pre-mixed toner container 50 reduces its volume. The guide member 54 may be formed of a sheet having a higher stiffness than a material used for the container package 51, and may be a thick paper, thin plastic sheet, or the like. The guide member 54 may be detachably mountable to the pre-mixed toner container 50, or may be fixed to the pre-mixed toner container 50.

The pre-mixed toner container 50 has a configuration so called gazette container, which can easily fold the container into a flat form. Specifically, when an amount of contents in the pre-mixed toner container 50 s decreased, the pre-mixed toner container 50 can be folded by folding faces 54*a* and 54*b* at a folding portion 54*c* of the guide member 54, wherein the faces 54*a* and 54*b* can be faced each other when the guide member 54 is folded at the folding portion 54*c*. With such folding effect of the guide member 54, the guide member 54 uniformly pushes the container package 51 inward of the pre-mixed toner container 50 from the folding portion 54*c*, by which the container package 51 can be folded into a flat form. Accordingly, the pre-mixed toner container 50 can be used as a volume reducible container.

With such effect of the guide member 54, a user can replace the pre-mixed toner container 50 easily. Further, the used pre-mixed toner container 50 folds substantially flat and can therefore be stored with occupying a minimum of space at a user location or the like, and can be contributed to a cost reduction, such as recovery and transport cost.

The container package 51 of the pre-mixed toner container 50 may be a one sheet composed of single material or a one sheet composed of a plurality of sub-sheets made of different materials adhered each other. When the container package 51 is made of the plurality of sub-sheets, such sub-sheets may be layered one another by considering material property of each of sub-sheets.

For example, the container package 51 includes an inner layer, an air-tight layer, and a stiffness layer. The inner layer, which directly contacts the developing agent, may be formed of a material that can be melted at a relatively low temperature, by which the inner layer can be tightly fused to the mouthpiece 52, and thereby an effective sealing performance can be obtained. The air-tight layer is used to enhance sealing performance of the pre-mixed toner container 50. If toner is exposed to ambient air during toner storage, toner may be degraded. Especially, toner may aggregate under a high humidity environment, and such aggregation may result into a defective toner supply. Accordingly, the air-tight layer, made of a material having a higher sealing performance, is used to prevent such defective toner condition. The stiffness layer is used to enhance a grip feeling of user. Because a user may grab the pre-mixed toner container 50 by hand, the pre-mixed toner container 50 may need a given level of such grip feeling so that the user can grab the pre-mixed toner container 50 easily. The stiffness layer may be made of a material having a relatively higher stiffness, and a desired stiffness of the pre-mixed toner container 50 can be attained by changing thickness of the stiffness layer.

As such, the container package 51 of the pre-mixed toner container 50 includes a layers composed of the inner layer, the air-tight layer layered on the inner layer sheet, and the stiffness layer layered on the air-tight layer. By sandwiching the air-tight layer with other two layers, the air-tight layer may be free from breakage, and a sealing performance can be maintained. Further, by providing the stiffness layer, having relatively higher anti-breakage property, at the outer side of the container package 51, the aforementioned fused portion of the mouthpiece 52 can be protected, and thereby a toner spillover can be prevented. Further, the container package 51 can include other layer other than such layers.

Figure 9:
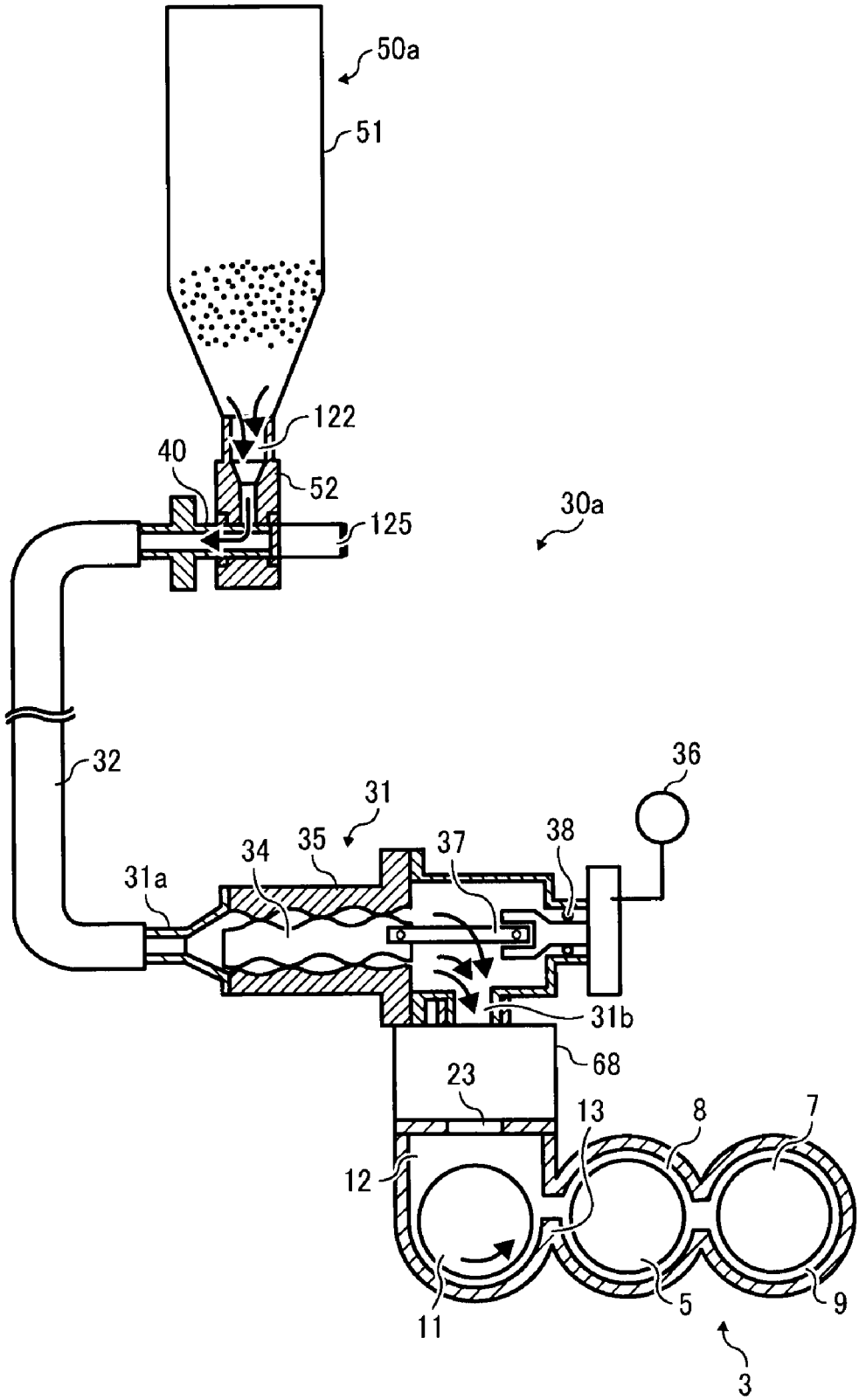
FIG. 9 illustrates a schematic configuration of pre-mixed toner refill unit according to another exemplary embodiment.
Figure 10:
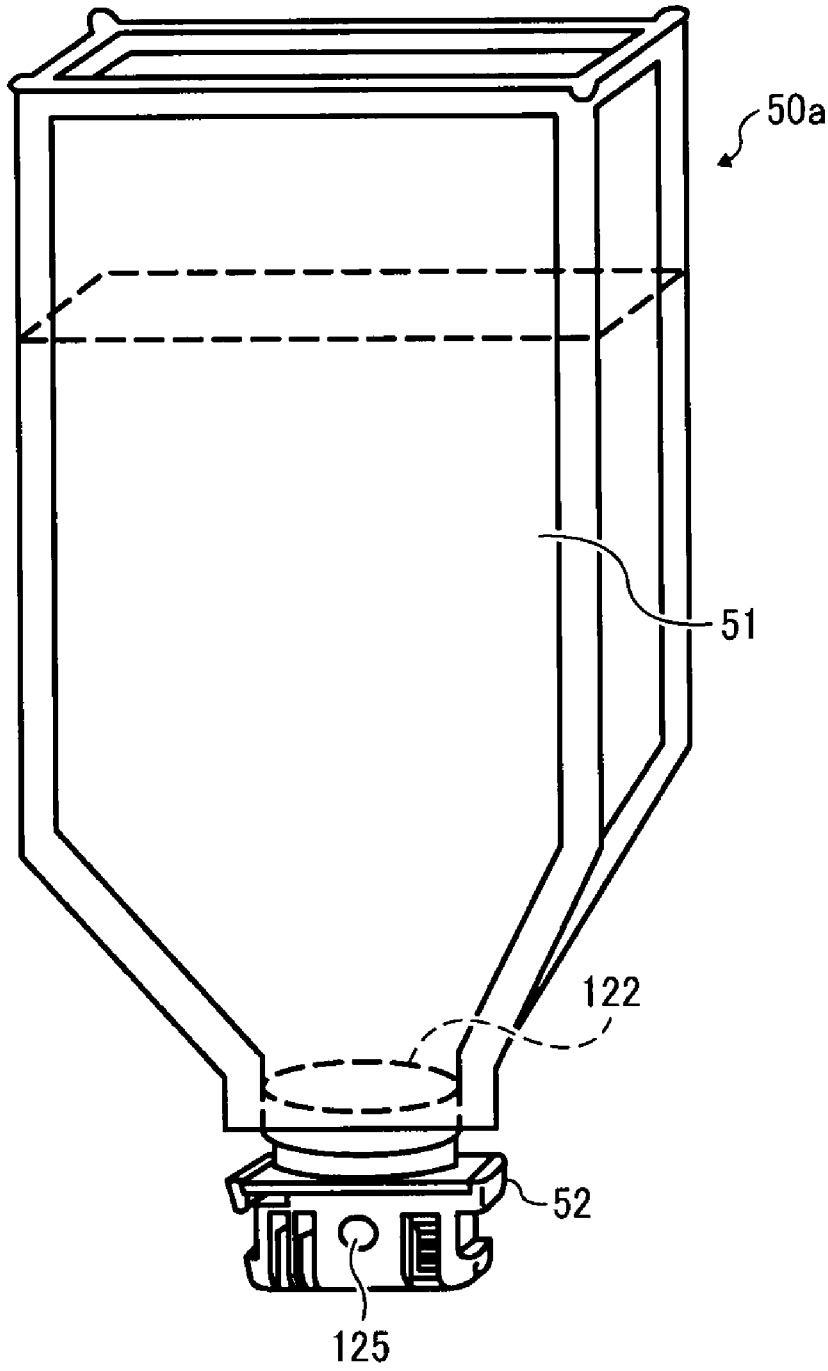
FIG. 10 illustrates a perspective view of a pre-mixed toner storage unit used for the pre-mixed toner refill unit of FIG. 9.
Figure 11:
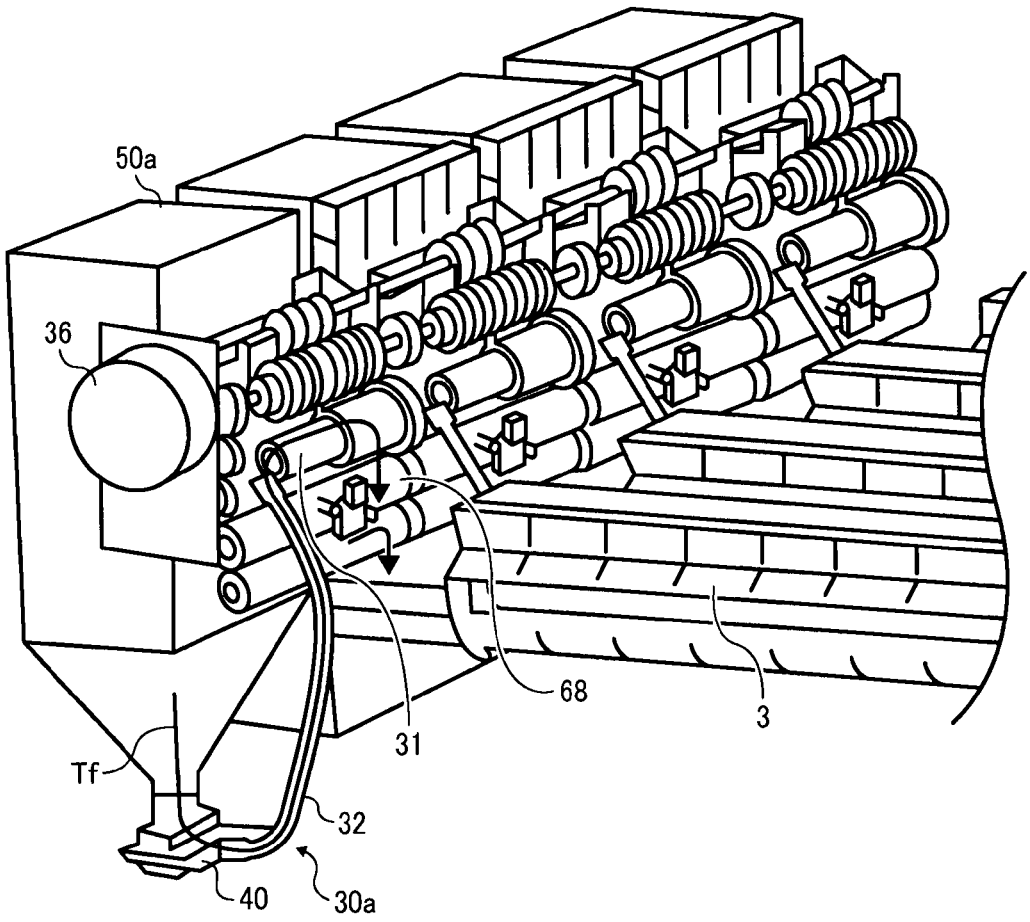
FIG. 11 illustrates a perspective view of the pre-mixed toner refill units of FIG. 9 arranged in tandem in an image forming apparatus.
Figure 12:
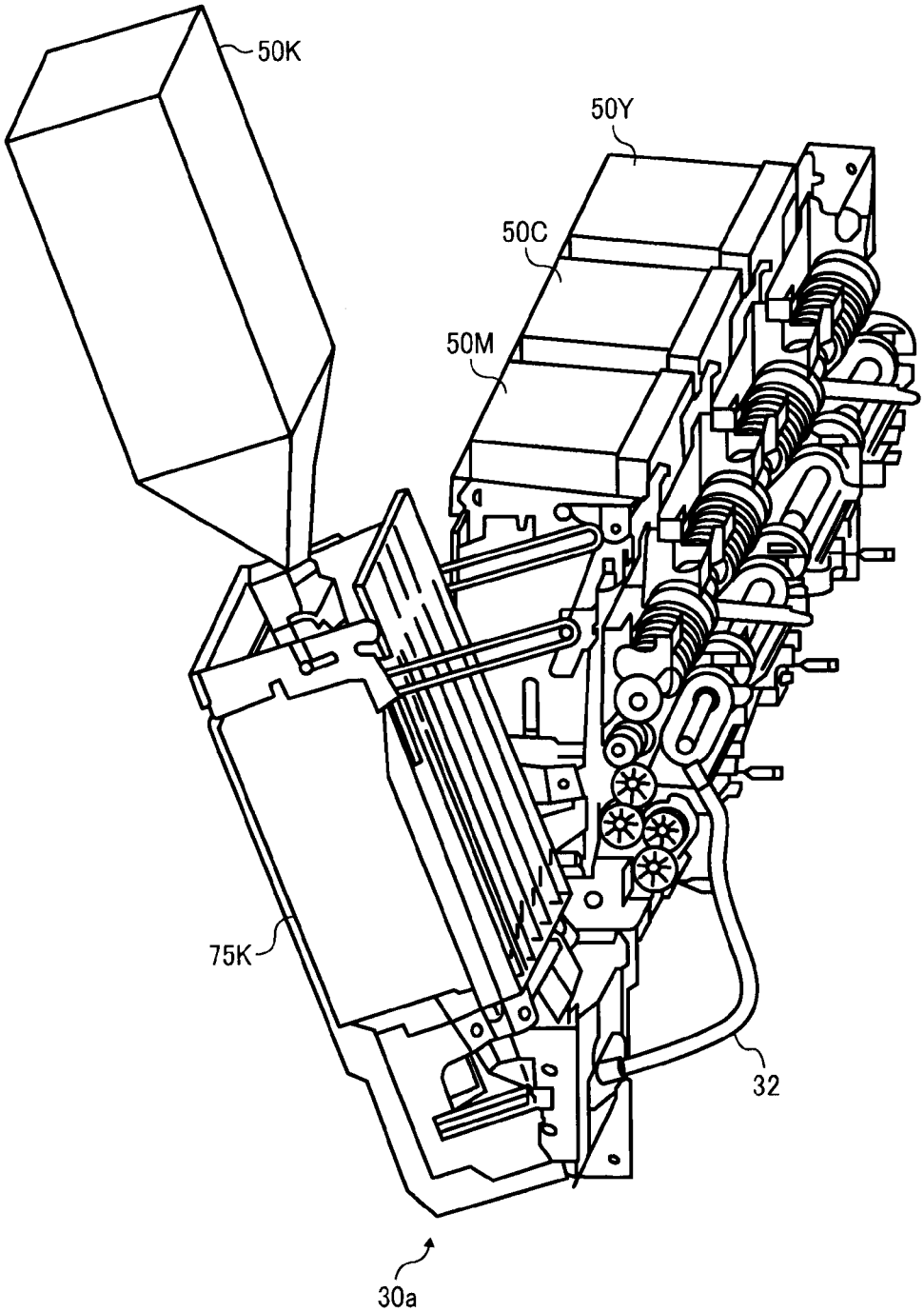
FIG. 12 illustrates a view how to set a pre-mixed toner storage unit to the pre-mixed toner refill unit of FIG. 11.
Figure 13:
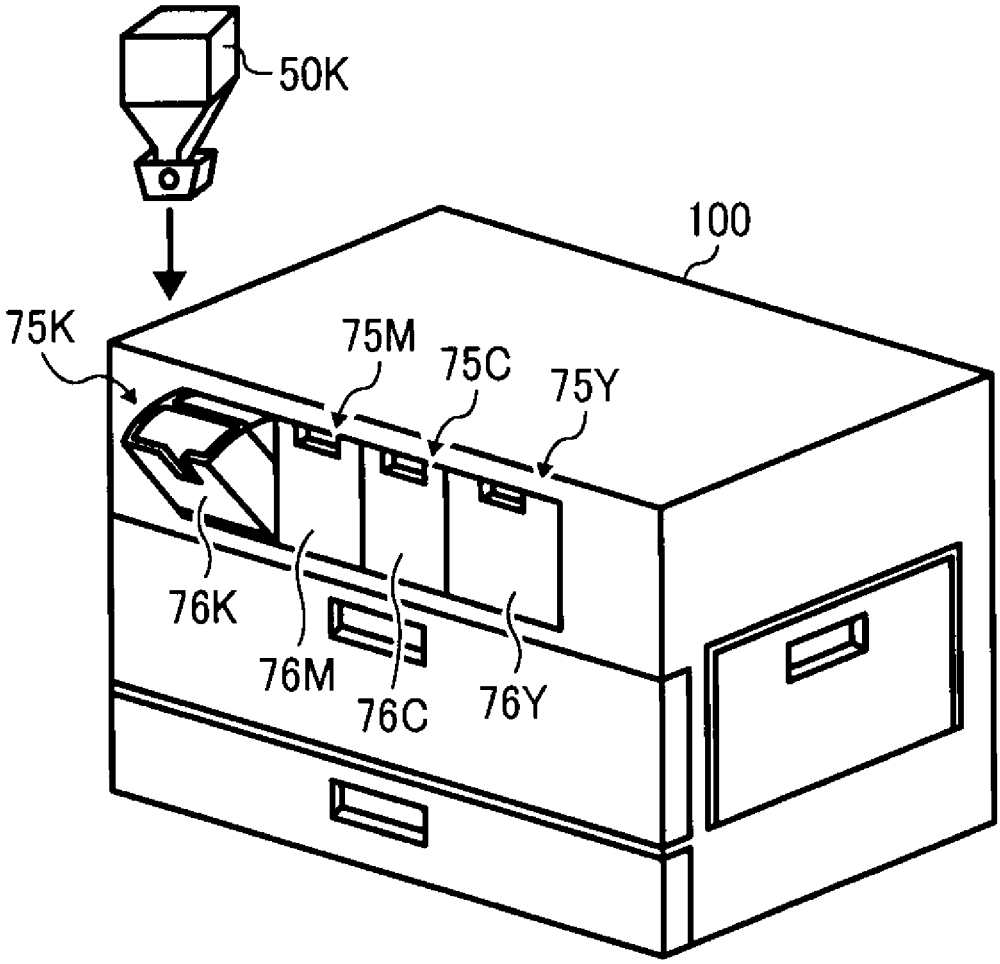
FIG. 13 illustrates a perspective view of an image forming apparatus having the pre-mixed toner refill unit of FIG. 12.

A description is now given to another pre-mixed toner refill unit and a pre-mixed toner container according to another exemplary embodiment with reference to FIGS. 9 to 13. FIG. 9 illustrates a schematic configuration of a pre-mixed toner refill unit 30*a* according to another exemplary embodiment. FIG. 10 illustrates a perspective view of a pre-mixed toner storage unit 50*a* used for the pre-mixed toner refill unit 30*a* of FIG. 9. FIG. 11 illustrates a perspective view of the pre-mixed toner refill unit 50*a* of FIG. 9 arranged in tandem in an image forming apparatus. FIG. 12 illustrates a view how to set the pre-mixed toner storage unit for K (black) color to the pre-mixed toner refill unit of FIG. 11, in which an arrow line Tf indicates a flow direction of the pre-mixed toner. FIG. 13 illustrates a perspective view of an image forming apparatus having the pre-mixed toner refill unit of FIG. 12.

The pre-mixed toner container 50*a* stores developing agent having toner and carrier particles, in which a ratio of toner in the developing agent is set higher than a ratio of toner in the developing agent used in the development unit 3. Such developing agent in the pre-mixed toner container 50 may be referred a "pre-mixed toner." When an image forming apparatus employs a tandem arrangement, a plurality of pre-mixed toner containers 50*a*, storing pre-mixed toner of each color, may be configured side by side as illustrated in FIG. 11.

The pre-mixed toner container 50*a* is coupled to the mohno pump 31 via the transport tube 32, and the mohno pump 31 is coupled to the development unit 3 via and a sub-hopper 68, in which the development unit 3 is positioned under the pre-mixed toner refill unit 30. As illustrated in FIGS. 9 and 10, the pre-mixed toner container 50 includes the container package 51 and the mouthpiece 52 having a toner exit port 122.

As illustrated in FIGS. 12 and 13, the pre-mixed toner refill unit 30*a* includes support holders 75Y, 75M, 75C, and 75K, which are rotatable about a rotation center (not shown). The support holders 75Y, 75M, 75C, and 75K can be set to an opened or closed condition. As illustrated in FIG. 13, each of the support holders 75 75Y, 75M, 75C, and 75K has side faces 76Y, 76M, 76C, and 76K, which are used as a part of a front face of an image forming apparatus 100. Each of the support holders 75Y, 75M, 75C, and 75K is provided to support the pre-mixed toner container 50*a* having stored a corresponding color toner.

The pre-mixed toner container 50*a* can be set to the support holder 75 as follows: when a user sets the pre-mixed toner container 50K for black color to the support holder 75K, the user unlocks a lock (not shown) and opens the support holder 75K by rotating the support holder 75K into a front side as illustrated in FIG. 13. Then, the user inserts a new pre-mixed toner container for black color into the support holder 75K while orienting the mouthpiece 52 to a vertically downward direction.

When the pre-mixed toner container 50*a* is set to the support holder 75, the nozzle 40 is inserted into the mouthpiece 52 of the pre-mixed toner container 50, by which the pre-mixed toner container 50 is coupled to the developing unit 3 in the image forming apparatus 100.

Specifically, the mouthpiece 52 includes a shutter device 125. When the pre-mixed toner container 50 is not set to the support holder 75, the shutter device 125 closes the toner exit port 122 to prevent a toner spillover from the pre-mixed toner container 50*a*. When the pre-mixed toner container 50*a* is set to the support holder 75, the nozzle 40 is pushed to the shutter device 125 of the mouthpiece 52, by which the nozzle 40 is inserted into the mouthpiece 52 of the pre-mixed toner container 50*a*, and the toner exit port 122 and the nozzle 40 are communicated as illustrated in FIG. 9. The nozzle 40 has a tube joint device connectable to the transport tube 32 coupled to the mohno pump 31, and the mohno pump 31 is communicated to the development unit 3 via the sub-hopper 68. With such coupling configuration, the pre-mixed toner container 50*a*, set to the support holder 75, is coupled to the development unit 3.

The mohno pump 31, illustrated in FIGS. 9 and 11, is a screw pump having the stator 35 and the rotor 34 as similar to a screw pump shown in FIG. 6. The rotor 34 is made of a hard material and formed in a helical shape in its cross sectional shape. The rotor 34 is engaged inside the stator 35. Further, the rotor 34 is coupled to the drive motor 36 via the universal joint 37, a drive force transmission device, and the bearing 38. The drive motor 36 drives the rotor 34. The stator 35 is made of a flexible material, such as rubber, and formed in a helical shaped hole, to which the rotor 34 is engaged. A helical pitch of the stator 35 is set a twice length of a helical pitch of the rotor 34, for example.

In such configured mohno pump 31, when the drive motor 36 rotates the rotor 34*a*, a suction pressure is generated in a helical space formed between the rotor 34*a* and the stator 35, by which negative pressure of gas stream, such as air stream, is generated in the transport tube 32. With such negative pressure generation, the pre-mixed toner in the pre-mixed toner container 50*a* is sucked to the mohno pump 31 via the transport tube 32 and the sucking port 31*a*.

The pre-mixed toner moves past the helical space formed between the rotor 34*a* and the stator 35, and drops from the exit port 31*b*, and then enters the development unit 3 via the sub-hopper 68 and the toner supply port 23, in which the development unit 3 is disposed below the sub-hopper 68.

In a configuration shown in FIGS. 9 to 13, the pre-mixed toner refill unit 30*a* sucks the pre-mixed toner in the pre-mixed toner container 50*a* using only the mohno pump 31. In contrast, the pre-mixed toner refill unit 30 shown in FIGS. 5 to 8, the pre-mixed toner refill unit 30 uses the mohno pump 31 to suck pre-mixed toner in the pre-mixed toner container 50, and also uses the gas pumps 45*a* and 45*b* to supply airflow into the pre-mixed toner container 50. With such airflow supply, the pre-mixed toner in the pre-mixed toner container 50 is agitated, by which the pre-mixed toner can be fluidized.

A description is now given to the aforementioned inner layer of the pre-mixed toner container 50, which is mentioned with reference to FIG. 8 or 10. The pre-mixed toner container 50 includes the inner layer made of a given material so that an electrostatic chargeability level of toner, carrier, and the inner layer can be set to an order of toner, inner layer, and carrier. Such order may be set from a negative charge side or positive charge side.

When two materials are charged by frictional pressure, a charge amount of materials becomes greater when such two materials have a greater difference on electrostatic chargeability level with each other, and a charge amount of materials becomes smaller when such two materials have a smaller difference on electrostatic chargeability level with each other. Accordingly, the greater the difference on electrostatic chargeability level, the greater the charge amount of materials. Further, the greater the charge amount of materials, the greater the electrostatic attraction of materials.

If the electrostatic chargeability level of toner, carrier, and the inner layer can be set to an order of toner, inner layer sheet, and carrier, a combination of toner and carrier can generate a greater charge amount than a combination of inner layer and carrier. Accordingly, the toner can be electrostatically attracted to the carrier surface more than the inner layer in the pre-mixed toner container 50, and the carrier may not adhere the inner layer of the pre-mixed toner container 50 so much. Under such condition, the pre-mixed toner can be discharged from the pre-mixed toner container 50 while toner particles are adhering on the surface of carrier particles effectively. Accordingly, when the pre-mixed toner is discharged from the pre-mixed toner container 50, an amount of carrier particles remaining on the inner layer can be reduced. Further, such discharged pre-mixed toner may not clog in the middle of the transport tube 32 or the like. This can be explained that toner particles adhering on the carrier surface may function as a tiny roller, by which the carrier particles can easily move in a tiny space formed between the rotor 34 and the stator 35, and in the transport tube 32.

Accordingly, when a developing agent is refilled from the pre-mixed toner container 50, such developing agent may not have defective carrier particles such as toner-spent carrier or coating-layer-abraded carrier, by which a given amount of carrier having good property can be effectively refilled to the developing unit 3. Therefore, degradation of developing agent in the developing unit 3 can be reduced or prevented.

In contrast, if the electrostatic chargeability level of toner, carrier, and the inner layer is not set to the aforementioned order, carrier particles or developing agent may not be effectively discharged from the pre-mixed toner container 50 and an amount of developing agent remaining in the pre-mixed toner container 50 may increase because an amount of carrier adhering to the inner layer may increase, which is not preferable.

The aforementioned electrostatic chargeability level of the inner layer, toner, and carrier can be determined by comparing a charge amount attributed to a combination of carrier and toner, and a charge amount attributed to a combination of carrier and inner layer, in which the inner layer is pulverized to a same size of toner particles. Materials are mixed under a same condition for each of two combinations, and then a charge amount is measured.

If such two combinations have same polarity and a combination of carrier and toner has a greater absolute charge amount than a combination of carrier and inner layer, the electrostatic chargeability level can be set to the aforementioned order: toner, inner layer, carrier.

If such two combinations have same polarity but a combination of carrier and toner has a smaller absolute charge amount than a combination of carrier and inner layer, the electrostatic chargeability level may be set to an order of inner layer, toner, and carrier from the positive charge side or negative charge side.

If such two combinations have opposite polarities, the electrostatic chargeability level may be set to an order of toner, carrier, and inner layer from the positive charge side or negative charge side.

Further, the aforementioned electrostatic chargeability level of the inner layer, toner, and carrier can be determined as below. A material of inner layer is pasted on a bottom of a glass bottle, and carrier and toner particles are put in the bottle. After capping the bottle, the bottle is shaken in upward and downward. Then, the bottle is upside down to check whether carrier or toner particles adhere the inner layer. If a mixture of carrier and toner particles does not adhere the inner layer, the electrostatic chargeability level may be determined as an order of toner, inner layer, and carrier.

In an exemplary embodiment, the inner layer of the pre-mixed toner container 50 may include a charge prevention agent, by which the inner layer may not be charged with toner or carrier so easily. Accordingly, a charge amount of toner and carrier can be set significantly greater than a charge amount of the inner layer and carrier, by which the aforementioned electrostatic chargeability level order of toner, inner layer, and carrier can be obtained. Examples of the charge prevention agent include a polymer having amide group; inorganic compounds, such as metal salt; and surfactant having carboxylic acid salt, sulfonic acid salt, quaternary ammonium salt, or phosphate. Such charge prevention agent is selectively used depending on a material of the inner layer.

Typically, an image forming apparatus has an alarm function to notify an amount of developing agent stored in a developing agent storage device, by which an agent-reduced condition in the developing agent storage device can be notified to a user. When such alarm is notified, a user may remove a developing agent storage device from the image forming apparatus and shake the storage device to fluidize the developing agent, which may be clogged or adhered in one portion in the developing agent storage device. Then, the user may set the developing agent storage device to the image forming apparatus again. The user may conduct such operation because user may think that the developing agent storage device has still some developing agent, which can be used.

However, such developing agent storage device may only include developing agent having insufficient amount of toner particles therein. For example, such developing agent storage device may only include carrier particles and may not include sufficient amount of toner particles. If only carrier particles are discharged from the developing agent storage device, refilling operations are conducted wastefully, and may cause unnecessary load to a refill unit in the image forming apparatus.

In view of such drawback, the pre-mixed toner container 50 used as a developing agent storage device according to an exemplary embodiment preferably has a transparent or see-through portion, through which an inside of the container can be viewable. The transparent or see-through portion may not need to have a perfect transparency, but may have a given level of transparency, which is effective to view the inside of the container.

If the inside of the container is viewable, the presence or absence of refill developing agent can be perceived. Accordingly, when a toner end condition is detected, a user may not shake the container having little amount of remaining materials and may not set such container to the image forming apparatus again.

If an amount of remaining materials in the container is great, the container may be set to the image forming apparatus again after shaking the container, and refill developing agent accumulated around the exit port can be supplied to the developing unit, by which a toner end condition can be canceled.

However, a developing agent storage device of an exemplary embodiment can discharge the developing agent effectively, by which an amount of remaining materials in the container may become small. If an amount of remaining materials in the container is small, such shaking process is useless and a refilling operation using such container may cause unnecessary load to the refill unit because the refill unit is activated without transporting the refill developing agent.

Accordingly, such container having a transparent portion, through which inside of the container is viewable, can be preferably used when a refill developing agent and the inner layer has the aforementioned electrostatic chargeability level order: toner, inner layer, and carrier.

Such transparent portion of the developing agent storage device is preferably made of a material having a transmission rate of 50% or more, and more preferably 70% or more. Such developing agent storage device may be made of a transparent material as a whole, or may include partially transparent portion. A transmission rate can be measured by a spectrophotometer using a piece of transparent portion used for the container.

A description is now given to pre-mixed toner filled in the pre-mixed toner container 50 in an exemplary embodiment. The pre-mixed toner used in an exemplary embodiment preferably includes carrier and toner particles, used as developing agent in the development unit 3. In other words, a same type of carrier and toner are used both for the pre-mixed toner container 50 and the development unit 3. With such agent preparation, the developing agent in the development unit 3 can be maintained at a given condition, such as initial condition, even if the pre-mixed toner is supplied into the development unit 3, by which variation of image quality level can be reduced or prevented.

A carrier concentration in the pre-mixed toner is preferably set from 1 wt % (weight %) to 30 wt %, and more preferably from 5 wt % to 20 wt %, for example. If the carrier concentration in the pre-mixed toner is too low, such developing agent (or pre-mixed toner) may not effectively suppress degradation of the developing agent in the development unit 3, and if the carrier concentration in the pre-mixed toner is too great, too much amount of the developing agent may be ejected from the development unit 3 and may result into cost increase. Further, carrier particles may not be necessarily dispersed uniformly in toner particles when carrier particles are filled in the pre-mixed toner container 50.

Carrier particles and toner particles stored as pre-mixed toner in the pre-mixed toner container 50 can be charged by frictional pressure, which may be generated when filling carrier particles and toner particles in the pre-mixed toner container 50. Most of the charging of the carrier particles and toner particles may be generated by shaking the pre-mixed toner container 50 before setting the pre-mixed toner container 50 to an image forming apparatus. With such shaking, carrier and toner particles can be effectively attracted with each other electrostatically.

Further, toner and carrier particles can be filled into the pre-mixed toner container 50 separately, or a developing agent having mixed a given amount of carrier particles in toner particles in advance can be filled into the pre-mixed toner container 50. In such developing agent having mixed carrier and toner in advance, the carrier and toner particles are already charged, by which toner particles may be electrostatically attracted to the carrier surface. Therefore, the carrier particles may not adhere on the inner layer of the pre-mixed toner container 50 even if the pre-mixed toner container 50 is not shaken before attaching to an image forming apparatus.

A ratio of carrier and toner particles in the developing agent may be set to a given range so that carrier and toner particles can be charged effectively, and toner particles can be effectively attracted to the carrier surface. Specifically, a coating ratio of carrier surface toner particles is preferably set to from 10% to 200%. Such coating ratio of toner on the carrier can be calculated from a mixing ratio of carrier and toner. It is assumed that if the coating ratio is 100% or less, one carrier surface may be coated with one layer of toner, and if the coating ratio is greater than 100%, one carrier surface may be coated with two or more layers of toner. It is assumed that such toner layer may not be evenly coated on the one carrier surface. For example, even when the coating ratio is calculated as 100%, some portion of carrier surface may not be coated with toner, but another portion of carrier surface may be coated with two or more layers of toner.

If the coating ratio is too low, the pre-mixed toner may not effectively suppress degradation of the developing agent in the developing unit 3, and if the coating ratio is too great, the pre-mixed toner may have unevenly dispersed carrier, by which the amount of carrier filled in the pre-mixed toner container 50 may vary unfavorably.

The developing agent filled in the pre-mixed toner container 50 may be same developing agent used in the developing unit 3, by which the developing agent used in the developing unit 3 and the developing agent to be filled in the pre-mixed toner container 50 can be prepared by a same one process.

The developing agent in the development unit 3 has a toner concentration of preferably from 90 wt % to 98 wt %, and more preferably from 93 wt % to 97 wt %. The developing agent can be mixed with a known mixing machine.

Toner used in an exemplary embodiment includes a binding resin and a colorant, and further includes a release agent, a charge control agent, and other component, as required. Further, the toner may be added with external additives, such as fluidity enhancing agent, or other components. Such materials may be known materials as described later.

In the pre-mixed toner storage unit 50 filled with toner particles having a charge control agent, a charging performance of toner particles can be set higher, by which the toner can be effectively charged with the carrier compared to the inner layer of the container package 51 even when the toner is formed of any types of binding resins. In such a case, the carrier may not adhere the inner layer so easily. Such toner preferably has a weight average particle diameter of from 3 μm to 12 μm, and more preferably from 3 μm to 8 μm from a viewpoint of enhancing image quality. Such toner particles may be included in the developing agent used in the developing unit 3.

Examples of binding resin include polymers of following monomers: styrene, para-chlorostyrene, vinyl toluene, vinyl chloride, vinyl acetate, vinyl propionic acid, (meth)acrylic acidmethyl, (meth)tacrylic acid ethyl, (meth)acrylic acid propyl, (meth)acrylic acid n-buthyl, (meth)acrylic acid isobuthyl, (meth)acrylic acid dodecyl, (meth)acrylic acid 2-ethylhexyl, (meth)acrylic acid lauryl, (meth)acrylic acid 2-hydroxyethyl, (meth)acrylic acid hydroxypropyl, (meth) acrylic acid 2-chloroethyl, (meth)acrylonitrile, (meth)acrylic amide, (meth)acrylic acid, vinyl methyl ether, vinyl ethylether, vinyl isobuthylether, vinyl methyl ketone, N-vinyl pyrrolidone, N-vinyl pyridine, and butadiene; copolymers of these monomer having two or more different monomers; and a mixture of these homopolymers and copolymers. Further, examples of binding resin include polyester resin, polyol resin, polyurethane resin, polyamide resin, epoxy resin, rosin, modified rosin, terpene resin, phenol resin, hydrogenerated oil resin, ionomer resin, silicone resin, ketone resin, and xylene resin. These can be used alone or in combination.

Suitable materials for use as the colorant include known dyes and pigments. Specific examples of the dyes and pigments include carbon black, Nigrosine dyes, black iron oxide, Naphthol Yellow S (C.I. 10316), Hansa Yellow 10G (C.I. 11710), Hansa Yellow 5G (C.I. 11660), Hansa Yellow G (C.I. 11680), Cadmium Yellow, yellow iron oxide, loess, chrome yellow, Titan Yellow, polyazo yellow, Oil Yellow, Hansa Yellow GR (C.I. 11730), Hansa Yellow A (C.I. 11735), Hansa Yellow RN (C.I. 11740), Hansa Yellow R (C.I. 12710), Pigment Yellow L (C.I. 12720), Benzidine Yellow G (C.I. 21095), Benzidine Yellow GR (C.I. 21100), Permanent Yellow NCG (C.I. 20040), Vulcan Fast Yellow 5G (C.I. 21220), Vulcan Fast Yellow R (C.I. 21135), Tartrazine Lake, Quinoline Yellow Lake, Anthrazane Yellow BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red F2R (C.I. 12310), Permanent Red F4R (C.I. 12335), Permanent Red FRL (C.I. 12440), Permanent Red FRLL (C.I. 12460), Permanent Red F4RH (C.I. 12420), Fast Scarlet VD, Vulcan Fast Rubine B (C.I. 12320), Brilliant Scarlet G, Lithol Rubine GX (C.I. 12825), Permanent Red F5R, Brilliant Carmine 6B, Pigment Scarlet 3B, Bordeaux 5B, Toluidine Maroon, Permanent Bordeaux F2K (C.I. 12170), Helio Bordeaux BL (C.I. 14830), Bordeaux 10B, Bon Maroon Light (C.I. 15825), Bon Maroon Medium (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue RS (C.I. 69800), Indanthrene Blue BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination. The use amount of colorant is usually 0.1 to 50 weight part with respect to the binding resin of 100 weight part.

Examples of the charge control agent include nigrosin dye, triphenyl methane dye, chrome included metal complex dye, molybdate chelate pigment, rhodamine dye, alkoxy amine, quaternary ammonium salt, such as fluorine modified quaternary ammonium salt, alkylamide or its compound, phosphorus or its compound, tungsten or its compound, fluorine-based activator, metal salt of salicylic acid and, and metal salt of salicylic acid derivative.

The use amount of charge control agent may be determined based on types of binding resin, the presence or absence of additives, toner manufacturing method including a dispersion method, or the like. Preferably, the charge control agent of 0.1 to 10 weight part is used with a binding resin of 100 weight part, and more preferably, the charge control agent of 2 to 5 weight part is used. If the amount of charge control agent is too small, toner particles may not have sufficient negative charge, which cannot be used practically. If the amount of charge control agent is too great, toner particles may have too great charging performance, and may be attracted with carrier with too great electrostatic force, by which the developing agent may have a degraded fluidity, and cause lower image concentration.

Examples of the release agent include low molecular weight polyolefin wax, such as low molecular weight polyethylene, low molecular weight polypropylene; synthetic hydrocarbon waxes including Fischer-Tropsh wax; natural waxes, such as bee wax, carnauba wax, candellia wax, rice wax, montan wax; petroleum waxes, such as paraffin wax, microcrystalline; and higher fatty acid, such as stearic acid, paltimic acid, myristic acid; metal salt of higher fatty acid, higher fatty acid amide, and modified wax of these. These materials can be used alone or in combination. Preferably, materials having a melting point from 70 to 125 degrees Celcius are used. If a material having a melting point of 70 degrees Celcius or more is used, toner may have a good transfer performance and durability, and if a material having a melting point of 125 degrees Celcius or less is used, toner can be quickly melted at a fixing process, and a releasing of toner can be effectively performed. The use amount of release agent is preferably from 1 wt % to 15 wt % with respect to toner particles. If the amount of release agent is too low, hot-offset resistance of the toner may not be effective, and if the amount of release agent is too great, a transfer performance and durability of toner may degrade.

Examples of fluidity enhancing agent include hydrophobic silica, titanium oxide, silicon carbide, aluminum oxide, and barium titanate. These materials can be used alone or in combination. Hydrophobicity silica or titanium oxide is preferably used from viewpoints of enhancing fluidity, charging stabilization, and image quality stabilization. More preferably, a combination of hydrophobicity silica and titanium oxide is used to obtain toner particles having enhanced fluidity and stabilized charging performance. The use amount of fluidity enhancing agent is preferably from 0.1 to 5 weight part with respect to toner weight, and more preferably from 0.5 to 2 weight part.

Toner particles used in an exemplary embodiment can be manufactured by known methods, such as a pulverization method. In the pulverization method, components of toner particle are melted, kneaded, and segmented size by size to obtain pulverized toner particles. Further, toner particles used in an exemplary embodiment can be manufactured by a polymerization method, such as a suspension polymerization method, an emulsion polymerization method, and a dispersion polymerization method. Further, toner particles used in an exemplary embodiment can be manufactured by a solution suspended method, a polymer suspended method, and an elongation reaction method, for example.

External additives can be added to toner particles by known methods. For example, fine particles of additives are mechanically mixed with mother toner particles using a mixer to add additives to the toner particles, or fine particles of additives and mother toner particles are uniformly dispersed in a liquid using a surfactant to adhere additives to the toner particles, and then toner particles are obtained by drying.

Carrier particles used in an exemplary embodiment can be selected from known materials. Such carrier particle preferably has a core material and a resin layer coated on the core material. The carrier preferably has an average particle diameter of from 20 μm to 100 μm, and more preferably from 20 μm to 45 μm to obtain higher quality image. Such carrier can be used as carrier included in the developing agent used in the developing unit 3.

The core material can be selected from known materials. For example manganese-strontium (Mn—Sr) or manganese-magnesium (Mn—Mg) having magnetism of 50 emu/g to 90 emu/g are preferably used. To obtain a higher image concentration, a highly magnetized material, such as iron powder (100 emu/g or more), magnetite (75 to 120 emu/g), or the like can be used. Further, when a low magnetized material, such as cupper-zinc (Cu—Zn) having 30 emu/g to 80 emu/g, is used, carrier and toner composing chains of magnetic brushes, may not be tightly attracted to each other, by which such magnetic brushes may contact a photoconductor gently, by which higher quality image can be preferably obtained. These materials can be used alone or in combination.

Examples of material for the resin layer include amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride and acrylic monomer, copolymer of vinylidene fluoride and fluorinated vinyl, fluoroterpolymer (e.g., terpolymer of tetrafluoroethylene/vinylidene fluoride/non-fluorinated monomer), and silicone resin. These can be used alone or in combination.

The resin layer may include conductive powder, as required. The conductive powder may be metal powder, carbon black, titanium oxide, tin oxide, zinc oxide, or the like. The conductive powder preferably has an average particle diameter of 1 μm or less. If the average particle diameter is too great, electric resistance cannot be controlled effectively.

The resin layer can be formed on the core material by known methods. For example, silicone resin may be solved in a solvent to prepare a coating solution, and the coating solution is applied on the core material uniformly by known application methods, and coated core material is dried and baked to form a carrier. Such application methods may be, for example, a dipping method, a spray method, and a brush application method.

The use amount of resin layer with respect to the carrier is preferably 0.01 wt % to 5.0 wt %. If the amount of resin layer is too low, the core material may not be uniformly coated by the resin layer, and if the amount of resin layer is too great, the resin layer becomes too thick, by which carrier particles may aggregate, and thereby uniformly-sized carrier particles may not be obtained.

A description is now given to experiments and results using Examples and Comparative Examples. It should be noted that the present invention is not limited such Examples. In the experiment, following toners A to D, carrier E, and pre-mixed toner storage units F to J were prepared. The pre-mixed toner container 50*a*, shown in FIG. 10, was used for the experiment.

Toner A

The following toner component materials were agitated and mixed by the Henschel mixer MF20C/I model (manufactured by Mitsui Miike Kako KK), then melted and kneaded by a twin screw kneading extruder (manufactured by TOSHIBA MACHINE CO., LTD.), and cooled. Then, the resultant products was pulverized, and segmented so that the mother toner component having the weight average particle diameter D4 of 6.5±0.5 μm and D4/D1 ratio of 1.15 to 1.20 was obtained, wherein the D1 is the number-average particle diameter of mother toner component. Then, the mother toner component was mixed with the following additives by Henschel mixer to obtain toner A.

(Mother Toner Component)

binding resin: copolymer of styrene 2-ethylhexyl acrylate of 95 weight part;

colorant: naphthol magenta pigment of 5 weight part;

release agent: carnauba wax of 5 weight part (Additives)

hydrophobicity silica (average primary particle diameter of 120 nm) of 0.8 weight part;

hydrophobicity silica (average primary particle diameter of 20 nm) of 0.8 weight part;

titanium oxide (average primary particle diameter of 15 nm) of 0.8 weight part

Toner B

Toner B was prepared as similar to toner A except using the followings for mother toner component.

(Mother Toner Component)

binding resin: polyol resin of 95 weight part;

colorant: same as toner A;

release agent: polyethylene wax of 5 weight part

Toner C

Toner C was prepared as similar to toner B except adding salicylic acid zinc salt of 2 weight part as a charge control agent.

Toner D

Toner D was prepared as similar to toner A except using the followings for mother toner component.

(Mother Toner Component)

binding resin: polyester resin of 95 weight part;

colorant: same as toner A;

release agent: same as toner A;

charge control agent: salicylic acid zirconium salt of 1 weight part

Carrier E

The following coating compositions were dispersed by a homomixer for 10 minutes to obtain a blended coating solution of acrylic resin and silicone resin having alumina particles. The blended coating solution is applied on the core material by using SPIRA COTA (registered trademark of OKADA SEIKO CO., LTD.) so as to set a coating layer having a thickness of 0.15 μm, and dried. The resultant carrier was baked in an electric heating furnace at 150 degrees Celcius for 1 hour. After cooling, a bulk of ferrite powder was cracked using a sieve having a mesh of 106 μm to obtain carrier E.

(Core Material)

baked ferrite powder, $(MgO)_{1.8}$ $(MnO)_{49.5}$ $(Ee_2O_3)_{48.0}$, having average particle diameter of 35 μm (Coating Compositions)

acrylic resin solution (solid part of 50 wt %) of 21.0 weight part;

guanamine solution (solid part of 70 wt %) of 6.4 weight part;

alumina particles (0.3 μm, specific resistance $10^{14}\Omega\cdot cm$) of 7.6 weight part;

silicone resin solution (solid part of 23 wtt %) of 65.0 weight part;

amino silane of 0.3 weight part;

toluene of 60 weight part;

buthyl cellosolve of 60 weight part

Pre-Mixed Toner Storage Unit F

The pre-mixed toner storage unit F was prepared by forming the inner layer of the pre-mixed toner storage unit 50*a* using polypropylene. The pre-mixed toner storage unit 50*a* had a configuration of the pre-mixed toner storage unit used for toner type C2 (magenta toner) included in an image forming apparatus of "imagio P" manufactured by Ricoh Company, Ltd. The inner layer was fused with the mouthpiece of the pre-mixed toner container.

Pre-Mixed Toner Storage Unit G

The pre-mixed toner storage unit G was prepared by forming the inner layer of the pre-mixed toner storage unit 50*a* using polyester.

Pre-Mixed Toner Storage Unit H

The pre-mixed toner storage unit H was prepared by forming the inner layer of the pre-mixed toner storage unit 50*a* using nylon.

Pre-Mixed Toner Storage Unit I

The pre-mixed toner storage unit I was prepared by forming the inner layer of the pre-mixed toner storage unit 50*a* using polyethylene.

Pre-Mixed Toner Storage Unit J

The pre-mixed toner storage unit J was prepared by forming the inner layer of the pre-mixed toner storage unit 50*a* using polyester having polyether ester amide.

The pre-mixed toner storage units F to J had a transmission rate of 70% or more on its side face, by which the inside of the storage units can be observed.

A description is now given to evaluation of Examples and Comparative Example. FIGS. 14 and 15 show the experiment results.

Electrostatic Chargeability Level of Inner Layer, Toner, Carrier of Pre-Mixed Toner Storage Unit The electrostatic chargeability level was determined by comparing a charge amount attributed to a combination of carrier and toner, and a charge amount attributed to a combination of carrier and inner layer.

Measurement of Charge Amount

Carrier 18 g and toner 2 g were put in a stainless ball mill (outer diameter 60 mm×60 mm), and mixed on a ball mill table rotating the mill at several hundreds rpm (revolution per minute) for 10 minutes, and then a charge amount of carrier and toner was measured by a blow-off method. A charge amount of carrier and the inner layer was similarly measured. The inner layer was pulverized to a same size of toner.

Refilling Performance Evaluation Pre-Mixed Toner

The pre-mixed toner refill unit 30*a* shown in FIGS. 9 and 11 was used to evaluate a refilling performance of the pre-mixed toner storage units F to J.

The pre-mixed toner was discharged from the pre-mixed toner storage unit by activating a suction pump with one-minute interval, in which the suction pump is operated for two second, and by activating a transport screw of sub-hopper with 10-second interval, in which the transport screw pump is operated for 0.6 second. The discharged pre-mixed toner was received by a vessel, set below the sub-hopper, and the amount of discharged pre-mixed toner agent was automatically counted. When the pre-mixed toner was not discharged from the pre-mixed toner storage unit any more, the operation was stopped. Such counted amount of discharged pre-mixed toner was used to determine an amount of pre-mixed toner remaining in the pre-mixed toner storage unit. Further, by blowing out toner particles from the remaining pre-mixed toner, toner was removed to determine an amount of carrier.

If the amount of remaining pre-mixed toner is less than 20 g and the remaining carrier amount is within 10 wt % of the initially filled amount of carrier, a refilling performance of pre-mixed toner has no problem.

Further, when determining the carrier amount, the pre-mixed toner storage unit was cut to check materials remaining inside the pre-mixed toner storage unit. If residual materials adhere the inner layer with a greater amount, it is evaluated that carrier or toner particles adhere the inner layer by electric charging, and pre-mixed toner is not discharged effectively (i.e., agent discharge was blocked). If residual materials are accumulated around the exit port, it is evaluated that carrier discharge performance of pre-mixed toner has no problem. FIG. 14 shows results of refilling performance of the pre-mixed toner used in the experiment.

Evaluation of Image Quality After Printing Greater Number of Images

The pre-mixed toner storage unit, filled with the pre-mixed toner, was set to an image forming apparatus "imagio Neo C600," manufactured by Ricoh Company, Ltd. Then, toner of 7 weight part and carrier of 93 weight part were agitated and mixed by a mixer to obtain a developing agent, and the developing agent of 450 g was filled in the developing unit of the imagio Neo C600. The developing agent set in the developing unit and the pre-mixed toner stored in the pre-mixed toner storage unit used same toner and carrier particles. The developing unit was modified to eject some of the developing agent depending on a total amount of developing agent in the developing unit.

The imagio Neo C600 was operated to continuously produce a magenta image having an image area ratio of 5% of A4 sheet for 100,000 sheets. The following evaluation was conducted at two stages: a first stage was at an initial stage of continuous printing, and a second stage was after printing 100,000 sheets. If the result is rank 3 or greater for each evaluation, an image quality has no problem. Further, if the evaluation level after printing 100,000 sheets was not decreased more than one rank compared to the initial stage, it is determined that a developing agent degradation was effectively reduced or prevented. For example, if an evaluation level of the initial stage is rank 5 and an evaluation level of after printing 100,000 sheets is rank 4 (i.e., rank is decreased for one level), it is determined that a developing agent degradation was effectively prevented. However, if an evaluation level of the initial stage is rank 5 and an evaluation level of after printing 100,000 sheets is rank 3 (i.e., rank is decreased for two levels), it is determined that a developing agent degradation was not effectively prevented. FIG. 15 shows evaluation results after printing 100,000 sheets.

(Evaluation of Image Concentration)

A black solid image (1 inch×1 inch) was output at four corners and a center of one A4 sheet (type 6200, PPC paper, manufactured by Ricoh Company, Ltd.), and such five images were measured to check image concentration. The image concentration was measured by 938 Spectrodensitometer (manufactured by X-RITE, INCORPORATED). If the result is rank 3 or greater (image concentration average value is 1.2 or more), an image quality has no problem.

Rank 5: image concentration is 1.4 or more

Rank 4: image concentration is 1.3 to 1.4

Rank 3: image concentration is 1.2 to 1.3

Rank 2: image concentration is 1.1 to 1.2

Rank 1: image concentration is less than 1.1

(Evaluation of Fogging)

A white solid image was output at five points on a first sheet and image concentration at the five points was measured. Similarly, image concentration at five points on a second sheet, which was not put through the image forming apparatus, was measured. The first and second sheets were same A4 white sheet (type 6200, PPC paper, manufactured by Ricoh Company, Ltd.).

By comparing the average image concentration value of the five points between the first sheet and the second sheet, fogging was evaluated. If no fogging appears on a sheet, the image concentration is same as a concentration value of original white sheet, and if the image concentration becomes greater, the fogging becomes worse. If the result is rank 3 or greater, an image quality has no problem.

Rank 5: image concentration increase from the original white sheet is less than 0.002

Rank 4: image concentration increase from the original white sheet is 0.002 to 0.005

Rank 3: image concentration increase from the original white sheet is 0.005 to 0.010

Rank 2: image concentration increase from the original white sheet is 0.010 to 0.020

Rank 1: image concentration increase from the original white sheet is 0.020 or more (Evaluation of Transfer Performance) A checkered pattern of black solid images (1 inch×1 inch) was output on a sheet, in which black solid images were formed in a matrix of four lines and four rows having a white area (or sheet face) between each of the black solid images. During such image was being output, the image forming apparatus was forcefully stopped to have a solid image on a photoconductor, which is an image before transferring to a transfer belt, and another solid image, which is an image transferred on the transfer belt. By comparing toner amount of solid images of before or after transferring image, a transfer rate (%) was computed using a following equation.

(Toner amount of solid image after transferring on transfer belt (mg))/(Toner amount of solid image before transferring on transfer belt (mg))×100

The adhered toner amount was computed by transferring toner particles of solid image to a tape, and then a weight of tape having particles was reduced by a weight of tape having no particles. If the result is rank 3 or greater, an image quality has no problem.

Rank 5: transfer rate of 98% or more

Rank 4: transfer rate of 95% to 98%

Rank 3: transfer rate of 90% to 95%

Rank 2: transfer rate of 85% to 90%

Rank 1: transfer rate of less than 85%

Example 1

The pre-mixed toner storage unit F, filled with toner A (531 g) and carrier E (59 g), was shaken in upward and downward for 10 times and then set to a refill unit of imagio Neo C600. Such refill unit is usually used as magenta refill unit.

A charge amount attributed to a combination of the carrier E and the inner layer of the pre-mixed toner storage unit F, and a charge amount attributed to a combination of the carrier E and the toner A were both negative side, and the absolute charge amount attributed to the combination of carrier/toner was greater than the absolute charge amount attributed to the combination of carrier/inner layer. Accordingly, the electrostatic chargeability level of the toner A, the carrier E, and the inner layer of the pre-mixed toner storage unit F were in an order of toner, inner layer, and carrier from the negative side.

Refilling performance of developing agent for Example 1 was evaluated that an amount of developing agent remaining in the pre-mixed toner storage unit F after the refilling operation was low, and electrostatic adhesion of the carrier to the inner layer of the pre-mixed toner storage unit F was not observed, by which it was verified that most of the carrier particles were discharged with the toner particles.

Further, it was evaluated that the image quality after printing 100,000 sheets had no problem based on the evaluation of continuous printing, by which it was verified that the refilling carrier reduced or prevented degradation of the developing agent even when a greater number of images were printed.

Example 2

The toner A of 7 weight part and the carrier E of 93 weight part were agitated and mixed by a mixer to obtain a developing agent. Such developing agent of 63.5 g and the toner A of 526.6 g were filled in the pre-mixed toner storage unit F, and then set to the refill unit of imagio Neo C600.

Although the pre-mixed toner storage unit F was not shaken before being set to the refill unit in Example 2, it was verified that a refilling performance of developing agent had no problem, and it was evaluated that the image quality after printing 100,000 sheets had no problem based on the evaluation of continuous printing.

Comparative Example 1

The toner B of 7 weight part and the carrier E of 93 weight part were agitated and mixed by a mixer to obtain a developing agent. Such developing agent of 63.5 g and the toner B of 526.6 g were filled in the pre-mixed toner storage unit G. The pre-mixed toner storage unit G was shaken in upward and downward for 10 times, and then set to a refill unit of imagio Neo C600.

A charge amount attributed to a combination of the carrier E and the inner layer of the pre-mixed toner storage unit G, and a charge amount attributed to a combination of the carrier E and the toner B were both negative side, and the absolute charge amount attributed to the combination of carrier/inner layer was greater than the absolute charge amount attributed to the combination of carrier/toner. Accordingly, the electrostatic chargeability level of the toner B, the carrier E, and the inner layer of the pre-mixed toner storage unit G were in an order of inner layer, toner, and carrier from the negative side.

Refilling performance of developing agent for Comparative Example 1 was evaluated that electrostatic adhesion of the carrier to the inner layer of the pre-mixed toner storage unit G was observed with a larger amount.

Further, the toner B used for Comparative Example 1 includes a resin having smaller charging performance, and did not include a charge control agent. In such Comparative Example 1, the image quality was lower than the image quality of Examples 1 and 2 from the initial stage of continuous printing, and it was evaluated that the image quality after printing 100,000 sheets was degraded to not-allowable level based on the evaluation for continuous printing.

Example 3

The pre-mixed toner storage unit G used for Comparative Example 1 was changed to the pre-mixed toner storage unit J, and then the pre-mixed toner storage unit J was set to the refill unit as similar to Comparative Example 1.

A charge amount attributed to a combination of the carrier E and the inner layer of the pre-mixed toner storage unit J, and a charge amount attributed to a combination of the carrier E and the toner B were both negative side, and the absolute charge amount attributed to the combination of carrier/toner was greater than the absolute charge amount attributed to the combination of carrier/inner layer. Accordingly, the electrostatic chargeability level of the toner B, the carrier E, and the inner layer of the pre-mixed toner storage unit J were in an order of toner, inner layer, and carrier from a negative side. Because the inner layer of the pre-mixed toner storage unit J included a charge prevention agent, charging performance of the inner layer became smaller than charging performance of toner.

Refilling performance of developing agent for Example 3 was evaluated that most of the carrier particles were discharged with the toner particles, and it was verified that a refilling performance had no problem.

Further, the image quality of Example 3 was enhanced from the image quality of Comparative Example 1 at the initial stage of continuous printing, and it was evaluated that the image quality degradation after printing 100,000 sheets became smaller than Comparative Example 1.

Example 4

The toner B used for Comparative Example 1 was changed to the toner C, and then the pre-mixed toner storage unit G was set to the refill unit as similar to Comparative Example 1.

A charge amount attributed to a combination of the carrier E and the inner layer of the pre-mixed toner storage unit G, and a charge amount attributed to a combination of the carrier E and the toner C were both negative side, and the absolute charge amount attributed to the combination of carrier/toner was greater than the absolute charge amount attributed to the combination of carrier/inner layer. Accordingly, the electrostatic chargeability level of the toner C, the carrier E, and the inner layer of the pre-mixed toner storage unit G were in an order of toner, inner layer, and carrier from the negative side. Because the toner C included a charge control agent for controlling charging at the negative side, charging performance of the toner became greater than charging performance of the inner layer.

Refilling performance of developing agent for Example 4 was evaluated that most of the carrier particles were discharged with the toner particles, and it was verified that a refilling performance had no problem.

Further, the image quality of Example 4 was enhanced from the image quality of Comparative Example 1 at the initial stage of continuous printing, and it was evaluated that the image quality degradation after printing 100,000 sheets became smaller than Comparative Example 1.

Example 5

The toner D of 7 weight part and the carrier E of 93 weight part were agitated and mixed by a mixer to obtain a developing agent. Such developing agent of 63.5 g and the toner D of 526.6 g were filled in the pre-mixed toner storage unit I. The pre-mixed toner storage unit I was shaken in upward and downward for 10 times, and then set to a refill unit of imagio Neo C600. Such refill unit is usually used as magenta unit.

A charge amount attributed to a combination of the carrier E and the inner layer of the pre-mixed toner storage unit I, and a charge amount attributed to a combination of the carrier E and the toner D were both negative side, and the absolute charge amount attributed to the combination of carrier/toner was greater than the absolute charge amount attributed to the combination of carrier/inner layer. Accordingly, the electrostatic chargeability level of the toner D, the carrier E, and the inner layer of the pre-mixed toner storage unit I were in an order of toner, inner layer, and carrier from the negative side.

Refilling performance of developing agent for Example 5 was evaluated that most of the carrier particles were discharged with the toner particles, and it was verified that a refilling performance had no problem.

Further, it was evaluated that higher quality image at the initial stage of continuous printing was maintained after printing 100,000 sheets based on the evaluation of continuous printing, by which it was verified that degradation of the developing agent was reduced or prevented by refilling carrier to the developing unit.

Comparative Example 2

The pre-mixed toner storage unit I used for Example 5 was changed to the pre-mixed toner storage unit H, and then the pre-mixed toner storage unit H was set to the refill unit as similar to Comparative Example 1.

A charge amount attributed to a combination of the carrier E and the inner layer of the pre-mixed toner storage unit H was positive side, and a charge amount attributed to a combination of the carrier E and the toner D was negative side. Accordingly, the electrostatic chargeability level of the toner D, the carrier E, and the inner layer of the pre-mixed toner storage unit H were in an order of toner, carrier, and inner layer sheet from the negative side.

Refilling performance of developing agent for Comparative Example 2 was evaluated that electrostatic adhesion of the toner particles or carrier particles having adhered toner to the inner layer of the pre-mixed toner storage unit H was observed with a larger amount, and thereby an amount of particles remaining in the pre-mixed toner storage unit H after the refilling operation was relatively greater.

Further, although the image quality of Comparative Example 2 was similar to the higher image quality of Example 5 at the initial stage of continuous printing, the image quality after printing 100,000 sheets was degraded to not-allowable level, and higher quality image was not maintained.

In the aforementioned exemplary embodiments, the pre-mixed toner container 50 or 50*a* includes the inner layer made of a given material so that the electrostatic chargeability level of toner, carrier, and the inner layer can be set to an order of toner, inner layer, and carrier. Such order may be set from the negative charge side or positive charge side. Accordingly, carrier particles in the pre-mixed toner container 50 or 50*a* can be reliably and effectively refilled to the development unit 3 with toner particles, by which a degradation of developing agent in the development unit 3 can be reduced or prevented.

Further, in the aforementioned exemplary embodiments, the pre-mixed toner container 50 or 50*a* can be used to prevent carrier-only discharging from the pre-mixed toner container 50. Accordingly, an operation stop of the mohno pump 31 caused by such carrier-only transport can be prevented, and refilling operation of the pre-mixed toner refill unit 30 can be performed without such stopping. Therefore, the pre-mixed toner refill unit 30 can reliably and effectively refill the developing agent to the developing unit 3.

Further, in the aforementioned exemplary embodiments, the pre-mixed toner container 50 or 50*a* is a volume reducible container, which can reduce its volume by an effect of external pressure or internal pressure. Accordingly, a used pre-mixed toner container 50 can be stored with occupying a minimum of space at a user location or the like, and can be contributed to a cost reduction, such as recovery and transport cost.

Further, in the aforementioned exemplary embodiments, if toner particles and carrier particles can be electrostatically attracted with each other in the pre-mixed toner container 50 or 50*a*, a failed agent discharge, such as toner-only or carrier-only discharge from the pre-mixed toner container, may not occur. As for the pre-mixed toner container 50 or 50*a*, carrier and toner particles may not need to be uniformly dispersed in advance before being filled into the pre-mixed toner container

50. The frictional charge of carrier and toner particles may occur when carrier and toner particles are filled in the pre-mixed toner container 50, and most of the frictional charge of carrier and toner particles can occur by shaking the pre-mixed toner container 50 or 50*a* before being set to an image forming apparatus.

Further, in the aforementioned exemplary embodiments, the pre-mixed toner container 50 or 50*a* may be filled with a developing agent, prepared by dispersing a given amount of carrier in toner particles in advance. If such developing agent is filled, carrier may not adhere the inner layer of the pre-mixed toner container 50 even if the pre-mixed toner container 50 is not shaken because toner particles are electrostatically attracted to the carrier surface.

Further, in the aforementioned exemplary embodiments, the pre-mixed toner container 50 or 50*a* may be filled with toner particles having a charge control agent. Such toner particles having the charge control agent can enhance its charging performance, by which toner particles can be easily charged with carrier particles compared with the inner layer of the pre-mixed toner container 50 or 50*a*, wherein such toner particles can be prepared from any types of binding resin. As a result, carrier particles may be less likely to adhere the inner layer of the pre-mixed toner container 50 or 50*a*.

Further, in the aforementioned exemplary embodiments, an image forming apparatus employing the pre-mixed toner container 50 or 50*a* can produce higher quality images for a large quantity of printings because degradation of developing agent in the development unit 3 can be reduced or prevented.

Further, in the aforementioned exemplary embodiments, an image forming apparatus includes the agent ejector 26 for ejecting the developing agent from the development unit 3, by which the total amount of the developing agent in the development unit 3 can be maintained at a given level.

Further, in the aforementioned exemplary embodiments, an image forming apparatus employs the mohno pump 31 as a powder pump, by which layout designs for connecting the pre-mixed toner container 50 or 50*a* and the development unit 3 can be devised to a variety of patterns (i.e., less restriction on layout design). Accordingly, internal designs of image forming apparatus can be devised to a variety of patterns.

Further, in the aforementioned exemplary embodiments, because the pre-mixed toner container 50 can be set to a position distanced from the development unit 3, a size reduction of the development unit 3 can be devised.

Further, in the aforementioned exemplary embodiments, an image forming apparatus employs the pre-mixed toner container 50 or 50*a* having a transparent portion used for checking the inside of the container, by which a user can recognize whether developing agent remains in the pre-mixed toner container 50 or 50*a* at the time of toner end detection or the like. If the user can recognize that the pre-mixed toner container 50 or 50*a* is almost empty, such container may not be set again to an image forming apparatus, by which a wasteful operation, such as container resetting, or unfavorable machine load using empty container can be avoided.

The developing unit according to exemplary embodiments can be employed for various types of image forming apparatuses. For example, in one image forming apparatus, a toner image formed on a photoconductor is directly transferred on a sheet, and in other image forming apparatus, a toner image formed on a photoconductor is temporarily transferred on an intermediate transfer member and then transferred to a sheet.

Further, the developing unit according to exemplary embodiments can be employed for an image forming apparatus producing a single color image, such as monochrome image, and an image forming apparatus producing a color image. As for the image forming apparatus for a single color image, one photoconductor and one developing unit is used. As for the image forming apparatus for a color image, toner images of each color may be sequentially formed on one photoconductor and such toner images are sequentially transferred to an intermediate transfer member or sheet. Further, the image forming apparatus for a color image may include a plurality of image forming units for each color, wherein each of the image forming units, arranged in tandem, has a photoconductor and a developing unit. Toner images formed on the photoconductors of the image forming units may be sequentially transferred to an intermediate transfer member or sheet.

As above described, a developing agent can be reliably supplied from a developing agent storage device to a developing unit of image forming apparatus according to an exemplary embodiment, by which degradation of developing agent can be reduced or prevented and the image forming apparatus can produce a higher quality image.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A developing agent storage device for storing a refill developing agent, comprising:

toner particles, composing the refill developing agent;

carrier particles, composing the refill developing agent; and an inner layer of the developing agent storage device, provided as a wall contacting the refill developing agent, wherein an electrostatic chargeability level of the toner particles, the carrier particles, and the inner layer is set in an increasing electrostatic chargeability level order of toner, inner layer, and carrier from any one of a negative charge side and a positive charge side.

2. The developing agent storage device according to claim 1, wherein the developing agent storage device is a volume reducible vessel when any one of an external pressure and internal pressure is applied to the developing agent storage device.

3. The developing agent storage device according to claim 1, wherein the toner particles and the carrier particles are electrostatically attracted to each other in the developing agent storage device.

4. The developing agent storage device according to claim 1, wherein the carrier particles are dispersed in the toner particles before the developing agent storage device is filled with the carrier particles and toner particles.

5. The developing agent storage device according to claim 1, wherein the toner particles include a charge control agent.

6. The developing agent storage device according to claim 1, wherein the inner layer includes a charge prevention agent.

7. The developing agent storage device according to claim 1, further comprising a transparent portion, through which an inside of the developing agent storage device container is viewable.

8. An image forming apparatus, comprising:

a latent image carrier configured to form a latent image;

a development unit configured to develop the latent image formed on the latent image carrier using a developing agent;

a developing agent refill device configured to refill the development unit with a developing agent, an amount of refilling developing agent being substantially equal to an amount of developing agent consumed in the development unit;

a developing agent storage device configured to store refill developing agent to be supplied to the development unit, the developing agent storage device being detachably mountable to the developing agent refill device, the developing agent storage device including:

toner particles, composing the refill developing agent;

carrier particles, composing the refill developing agent; and an inner layer of the developing agent storage device, provided as a wall contacting the refill developing agent, wherein an electrostatic chargeability level of the toner particles, carrier particles, and inner layer is set in an increasing electrostatic chargeability level order of toner, inner layer, and carrier from a negative charge side or positive charge side.

9. The image forming apparatus according to claim 8, wherein the developing unit includes an agent ejection unit configured to eject the developing agent from the developing unit.

10. The image forming apparatus according to claim 8, wherein the developing agent refill unit includes:

a transport route device configured to transport the refill developing agent discharged from the developing agent storage device; and a powder pump configured to exert negative pressure on the refill developing agent in the developing agent storage device to move the refill developing agent from the developing agent storage device to the developing unit through the transport route device.

* * * * *